US005509591A

United States Patent [19]

Carver

[11] Patent Number: 5,509,591

[45] Date of Patent: Apr. 23, 1996

[54] HOLSTER

[76] Inventor: John W. Carver, 400 Biltmore Dr., Ste. 530, Fenton, Mo. 63026

[21] Appl. No.: 307,934

[22] Filed: Sep. 16, 1994

Related U.S. Application Data

[63] Continuation-in-part of Ser. No. 164,640, Dec. 7, 1993, which is a continuation of Ser. No. 818,787, Jan. 9, 1992, abandoned.

[51] Int. Cl.[6] ..... F41C 33/02

[52] U.S. Cl. ..... 224/244; 224/911

[58] Field of Search ..... 224/243, 247, 224/245, 192, 193, 198, 238, 911, 912

[56] References Cited

U.S. PATENT DOCUMENTS

| | | | |
|---|---|---|---|
| 1,917,844 | 7/1933 | Keith | 224/244 X |
| 4,256,243 | 3/1981 | Bianchi et al. | 224/244 |
| 4,270,680 | 6/1981 | Bianchi | 224/198 X |
| 4,277,007 | 7/1981 | Bianchi et al. | 224/193 |
| 4,318,503 | 3/1982 | Capano | 224/244 |
| 4,925,075 | 5/1990 | Rogers | 224/244 |
| 5,018,654 | 5/1991 | Rogers et al. | 224/244 |
| 5,048,735 | 9/1991 | McCormick | 224/244 |
| 5,050,786 | 9/1991 | Demott | 224/245 X |
| 5,129,562 | 7/1992 | Bianchi | 224/244 |

OTHER PUBLICATIONS

Eagle Industries Unlimited, Inc. 1992 Catalog pp. 9–35 especially.

Eagle Industries Unlimited, Inc., 1993 Catalog pp. 1, 2, 12–18, 21, 23, 27–28, 29, 31, 58, 59.

*Primary Examiner*—Allan N. Shoap
*Assistant Examiner*—Christopher J. McDonald
*Attorney, Agent, or Firm*—Heller & Kepler

[57] ABSTRACT

A holster for holding a weapon within the holster against the forced removal of the weapon from the holster. The holster includes a projection associated with a biased weapon holding mechanism for engagement of a trigger guard.

17 Claims, 22 Drawing Sheets

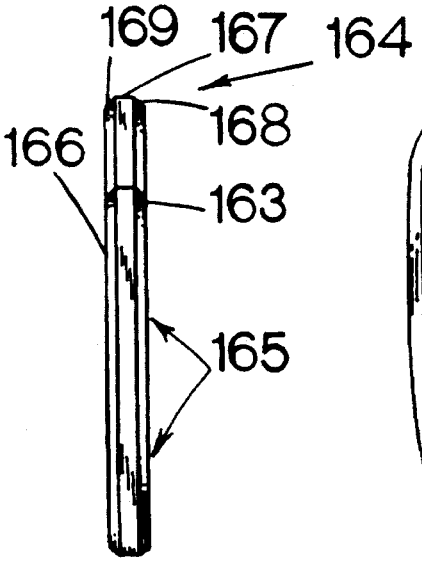
FIG.18.
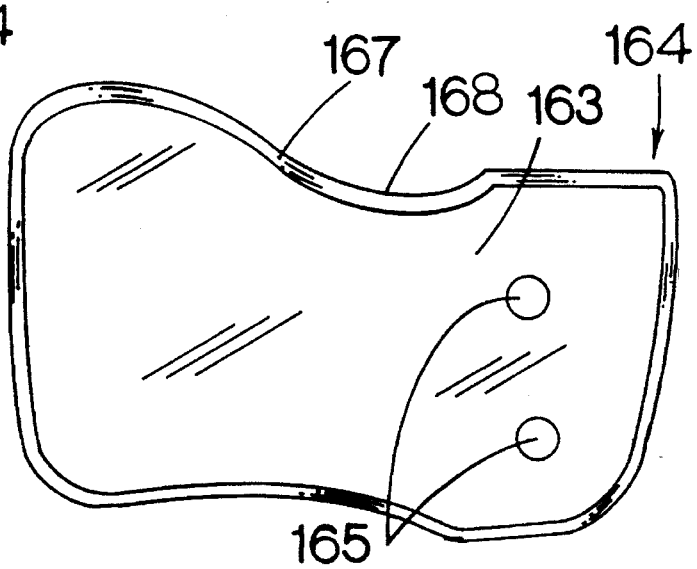
FIG.17.
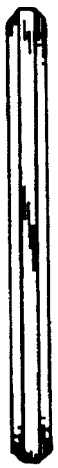
FIG.21.
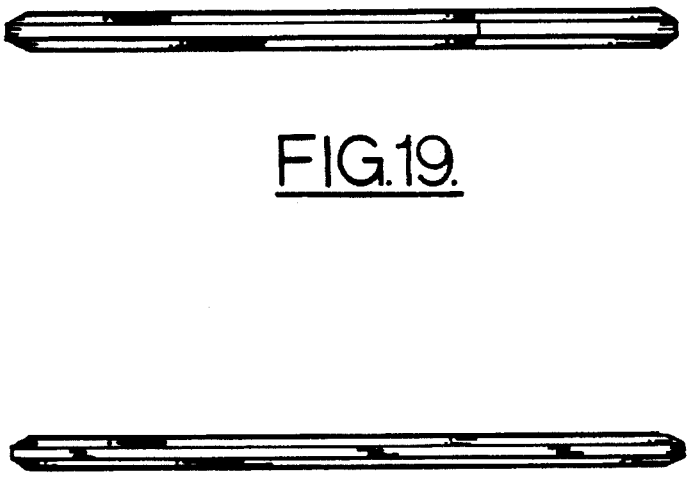
FIG.19.
FIG.20.

HOLSTER

CROSS-REFERENCE TO RELATED APPLICATIONS

This application is a continuation-in-part of application Ser. No. 164,640, filed Dec. 7, 1993, which is a continuation of application Ser. No. 818,787, filed Jan. 9, 1992, now abandoned.

BACKGROUND OF THE INVENTION

The present invention is related in general to an improved holster and pertains, more particularly, to a holster for holding a weapon within the holster and resisting attempts to force removal of the weapon or accidental removal of the weapon. The holster of this invention is an improvement over the conventional weapon holster with weapon restraining straps that can fail to provided the desired restraint under particular circumstances.

With the conventional weapon holster it is generally necessary to provide an assembly to keep a weapon in the holster. For example, it is typical that a weapon, particularly for use by a police force or a military force, is placed in a holster for quick removal. The weapon in this situation is often ready to discharge in case the need arises. Even in the event that the user either has to move or forcibly restrain another, the weapon may still be kept at the ready.

A drawback associated with the foregoing situation is that it has been known for the restrained individual to get free or during a struggle to obtain the weapon from the holster by releasing a weapon restraining strap or straps.

Similarly, while the weapon is ready for use and in the holster, the physical movements of the wearer may result in the holster being upside down. In this latter situation, if the weapon restraining device has been loosened in anticipation of its use, the weapon may fall out of the holster without the wearer realizing that the weapon is gone or unreachable.

Existing weapon holsters also have a drawback associated with the fact that the straps or fasteners, or similar arrangement, used to hold the weapon in the holster may wear out and increase the chance of failure at just the wrong time from the holster wearer's point of view.

Accordingly, it is an object of the invention to provide an improved holster that is adapted to decrease the risk that a wearer of the holster will accidently or forcibly, under certain circumstances, lose the weapon from the holster. With the holster of this invention it is believed that the wearer of the holster will not lose the weapon except under extraordinary circumstances.

Another object of the present invention is to provide an improved holster that is constructed to provide a weapon release mechanism that can be incorporated into conventional holsters or retro-fitted to existing holsters.

A further object of the present invention is to provide an improved holster that may be readily used by an individual without impairment to the use of the holster or the weapon.

Still another object of the present invention is to provide an improved holster that is adapted for use under relatively extreme environmental conditions and in relatively tense circumstances.

Still another object of the present invention is to provide an improved holster in which the weapon is normally retained within the holster, but can easily be manually released by the wearer of the holster.

SUMMARY OF THE INVENTION

To accomplish the foregoing and other objects of this invention there is provided a holster for holding a weapon in the holster until the holster wearer chooses to remove the weapon.

The holster comprises a means for holding a weapon within a holster against the forced removal of the weapon from the holster. The holding means includes a first engagement means and a second engagement means. The first engagement means engages a portion of the weapon in the event that an attempt is made to forcibly remove the weapon from the holster. The second engagement means functions to release the weapon from the holster by changing the position of the first engagement means relative to a portion of the weapon.

In a preferred embodiment there is included another engagement means. This latter engagement means is provided to limit insertion of the weapon into the holster.

In an alternative embodiment a holding means is provided that includes a weapon retaining projection and a release extension. The holding means is biased by a biasing plate so that the retaining projection engages a portion of the weapon. Upon the application of sufficient force against the release extension to overcome the bias, the retaining projection is disengaged from the weapon, allowing the weapon to be inserted or removed from the holster. A reinforcing support allows the retaining projection to be disengaged from the weapon without deflection of the holster from its normal position.

In another alternative embodiment and a preferred embodiment as of the filing of the present application, the weapon retaining projection is part of or attached to the release extension intended to be engaged by the holster wearer to release the weapon from the holster. In the presently preferred embodiment it has been determined that the separate biasing plate may not be necessary. The drawing figures illustrate this presently preferred embodiment. It has also been discovered that the addition of a sight guide to the inside portion of the holster has been found to help direct the weapon into the holster and protect the holster material from tearing and excess wear.

The holster of the present invention in any of its embodiments is preferably adapted for either right hand or left hand weapons of the semi-automatic or revolver style.

In the disclosed embodiments described herein, a semi-automatic weapon is described. For purposes of further disclosure, additional drawings are provided illustrating the manner in which the various embodiments of the present invention are readily used for revolvers. Also, in the different embodiments the holding and engaging device members are made of a high impact resistant, resilient or flexible plastic with sufficient shape memory to function as described and claimed herein.

These and other objects and features of the present invention will be better understood and appreciated from the following detailed description of various embodiments thereof, selected for purposes of illustration and shown in the accompanying drawings.

BRIEF DESCRIPTION OF THE DRAWINGS

FIG. 17 is a front view of the paddle stabilizer of the embodiment illustrated in FIG. 10;

FIG. 18 is a left end elevation view of the paddle stabilizer of the embodiment illustrated in FIG. 10;

FIG. 19 is a top view of the paddle stabilizer of the embodiment illustrated in FIG. 10;

FIG. 20 is a bottom view of the paddle stabilizer of the embodiment illustrated in FIG. 10;

FIG. 21 is a right end elevation view of the paddle stabilizer of the embodiment illustrated in FIG. 10;

DETAILED DESCRIPTION

Figure 2:
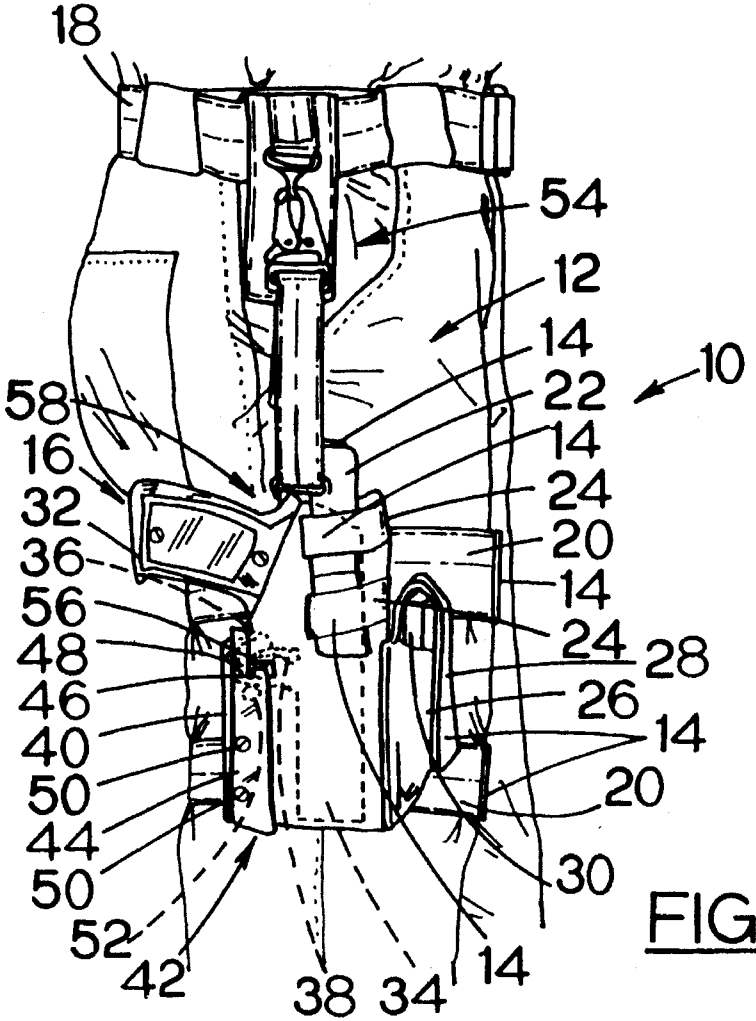
FIG. 2 is a side elevation of another improved holster constructed in accordance with the present invention.
Figure 1:
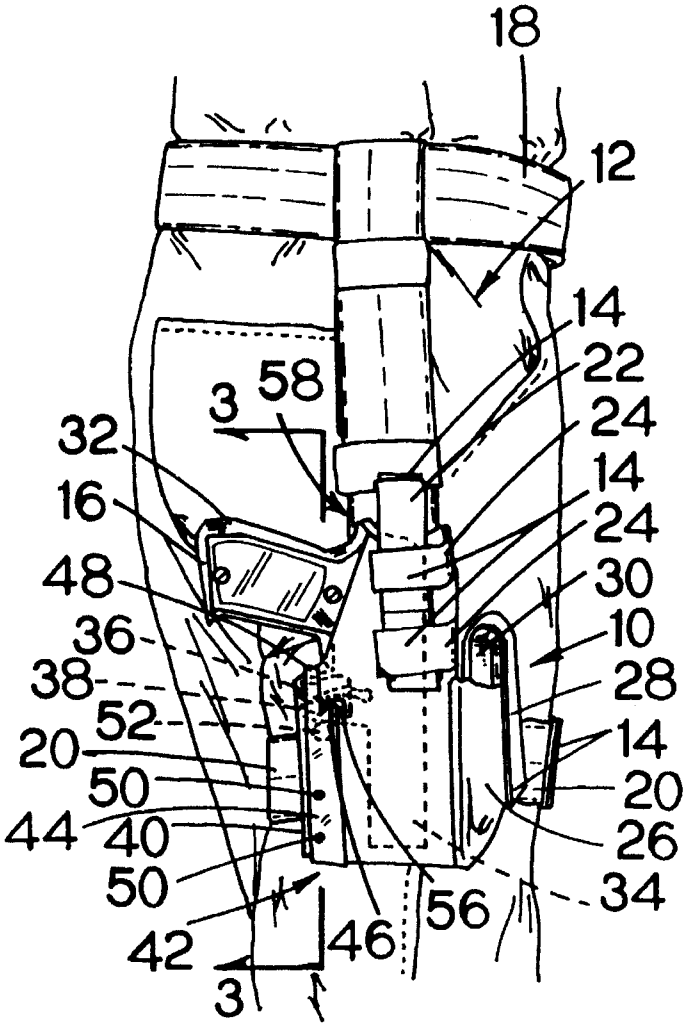
FIG. 1 is a side elevation view of an improved holster constructed in accordance with the present invention showing a weapon in dashed lines to illustration the construction as well as the operation of the present invention.
Figure 3:
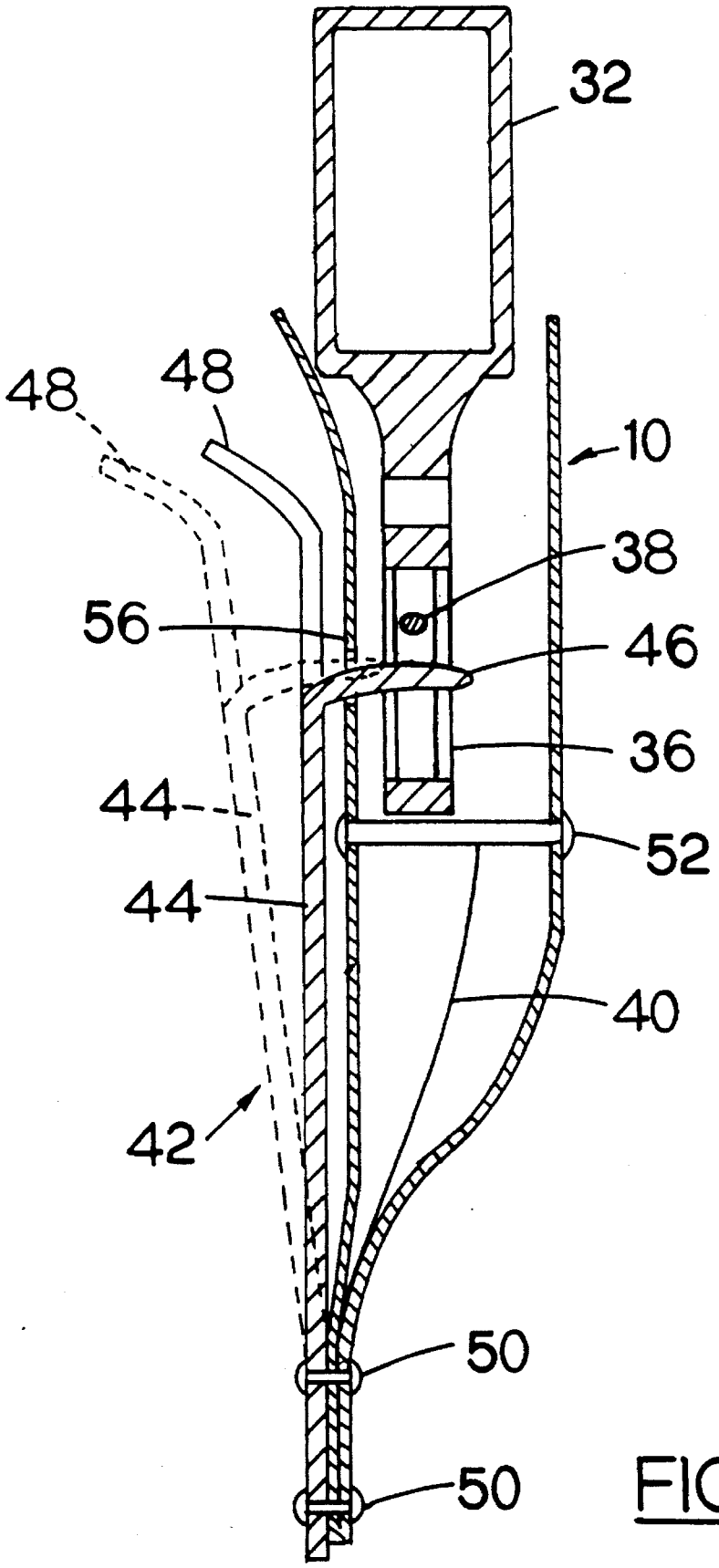
FIG. 3 is a cross-sectional view taken along line 3—3 in FIG. 1.
Figure 5:
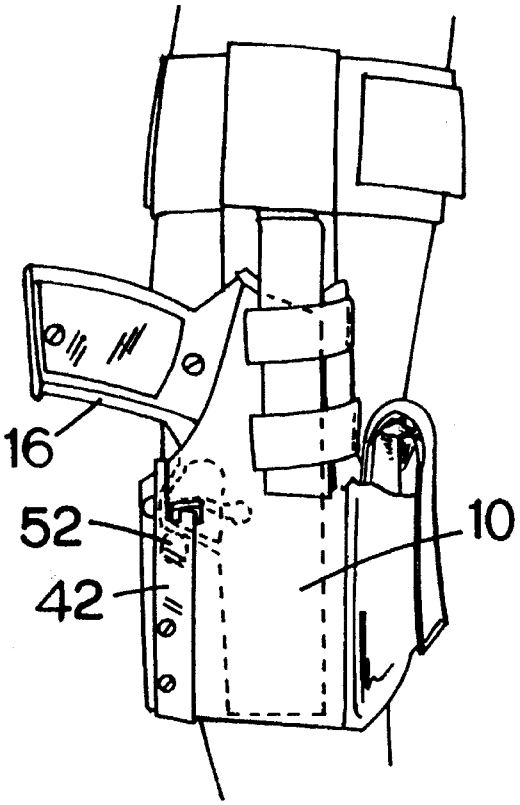
FIGS. 4–9 are side elevations of additional embodiments of the present invention illustrated as incorporated into a variety of waist, leg, arm, and side holsters.
Figure 4:
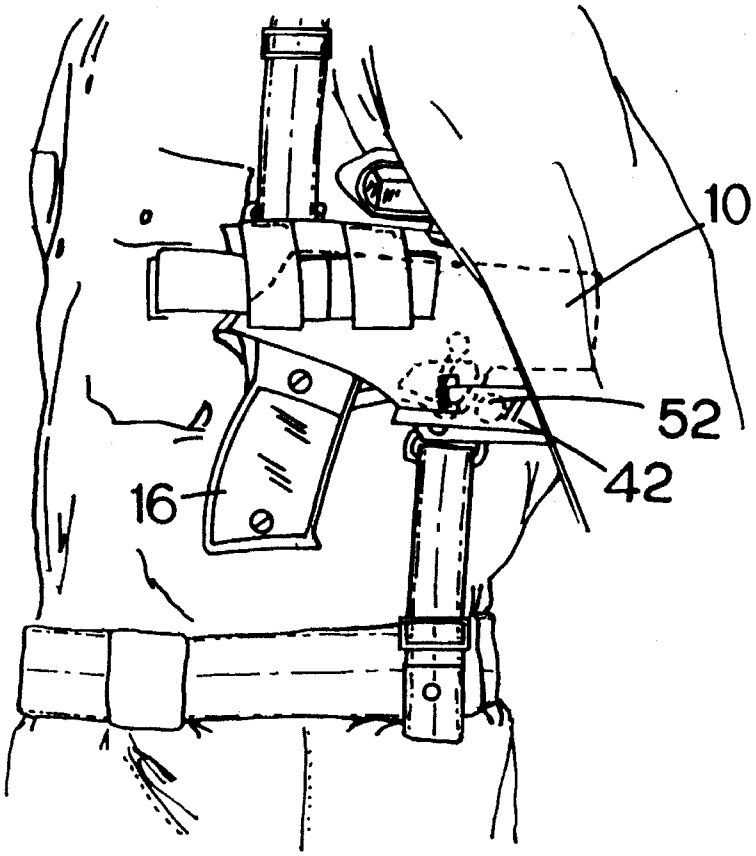
Figure 7:
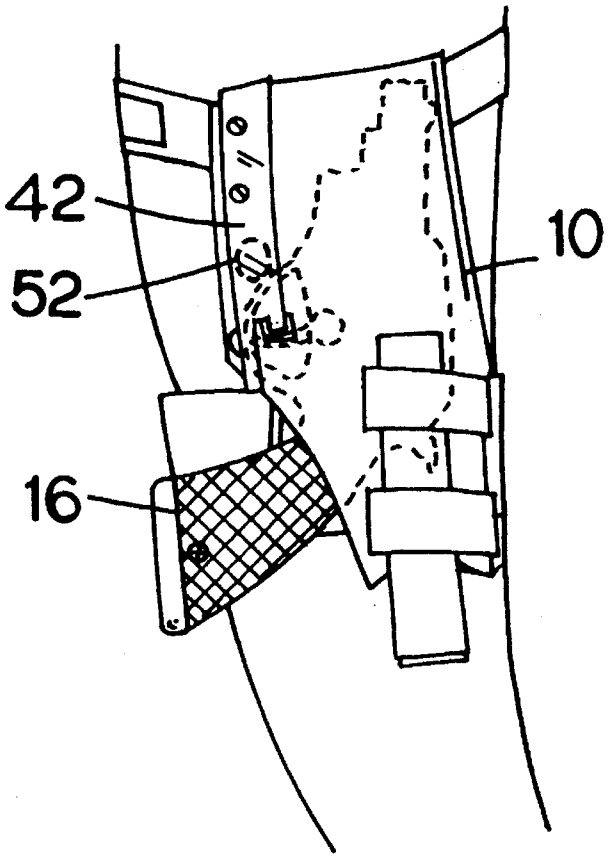
Figure 6:
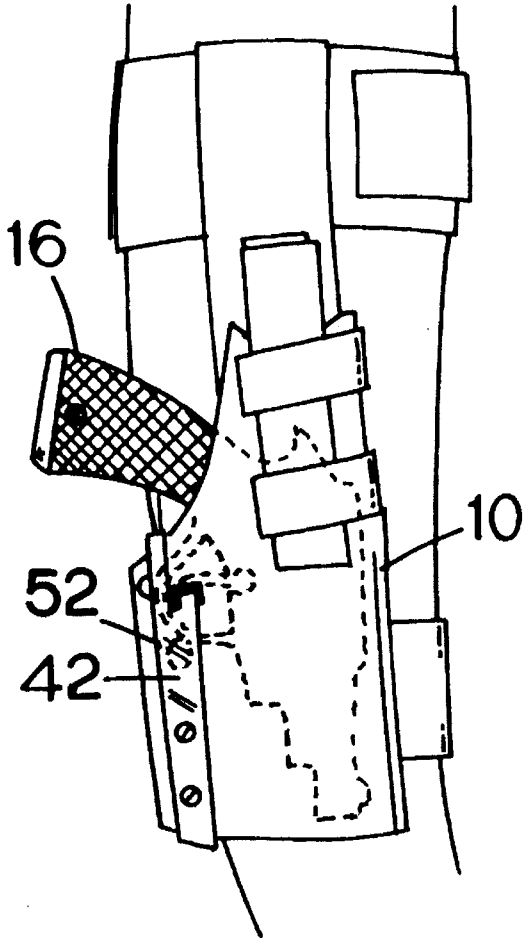
Figure 9:
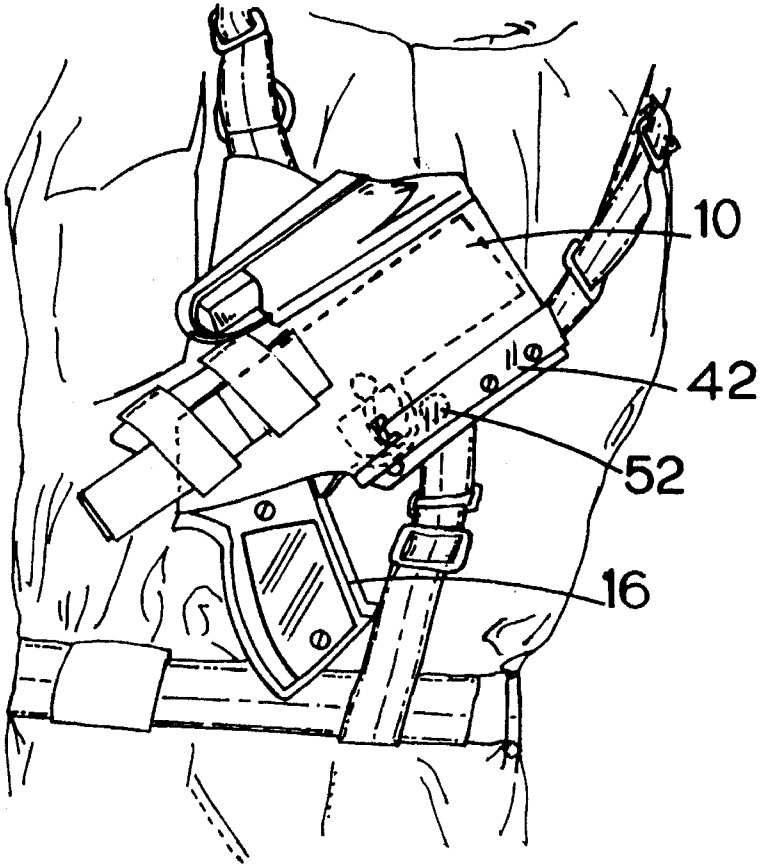
Figure 8:
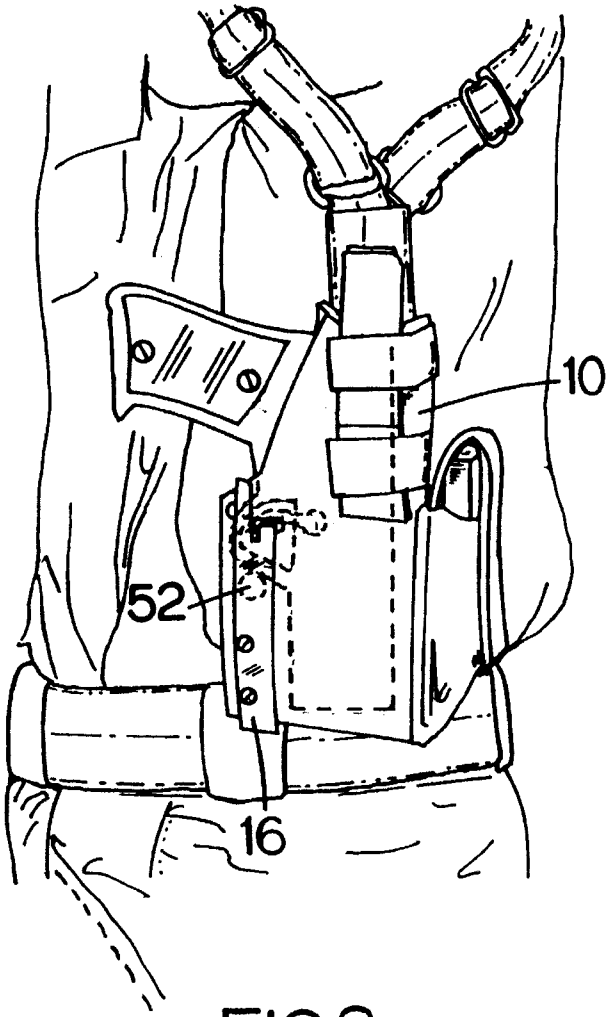

Referring now to the drawings there are shown a number of earlier and presently preferred embodiments for the improved holster of the present invention. Each embodiment of the holster of the present invention is described in connection with a semi-automatic sidearm or revolver to hold the weapon in the holster. The improved holster of the present invention is particularly adapted for providing a secured weapon in the holster and is characterized by a mechanism and a method for holding the weapon within the holster until the wearer of the holster desires to release the weapon.

The FIGS. 1–9 show the improved holster 10 for use with either a right hand or a left hand weapon (right hand weapon shown). The holster comprises the conventional features of an adjustable support system 12, with a number of hook and loop style fasteners 14 used typically with a conventional holster. A weapon, either a semi-automatic or a revolver 16 is depicted in each illustration of a holster incorporating the present invention.

It will be readily seen from the drawing figures, wherein like members are identified by like reference characters, that the conventional holster includes or may include as the case may be, a belt 18 and a leg strap or straps 20.

The modern holster, particularly the type used by law enforcement or the military, is often equipped with a hammer strap 22 that is the sole means for holding the weapon, whether or not it is ready to fire, in the holster 10. Typically, one or more securing straps 24 are provided to further secure the hammer strap in place. (Note that the term hammer strap is used generically and should be understood to include semi-automatic weapons not having a conventional hammer.)

Other features found on the conventional holster and the holsters of the present invention include an accessory pocket 26 (optional in some instances) and associated pocket closure straps 28. An additional ammunition clip 30 or other accessory may be stored in the pocket.

A conventional weapon includes a grip 32, a barrel 34, a trigger guard 36, and a trigger 38.

The improved holster 10 comprises a means for holding a weapon within a holster against the forced removal of the weapon from the holster. The holding means includes a first engagement means and a second engagement means. The first engagement means engages a portion of the weapon in the event that an attempt is made to forcibly remove the weapon from the holster. The second engagement means functions to release the weapon from the holster by changing the position of the first engagement means relative to a portion of the weapon.

In a preferred embodiment of holster 10 the engagement means is an extension of a flexible or resilient member attached to the holster 10. The holster 10 will have an edge 40 that is a reinforced, sewn edge in a preferred embodiment. A weapon lock and release mechanism 42 of the present invention is attached to the holster edge 40.

In the embodiments illustrated in FIGS. 1–9, the mechanism 42 includes an elongated flexible or resilient strip 44 having a first extension 46 that extends from an end and generally bends into the holster and within the trigger guard 36 without engaging the trigger 38. Another extension 48 extends past the first extension and up and, in a preferred embodiment, slightly out from the adjacent surface of the holster.

This mechanism is preferably firmly attached to the holster by rivets 50 or otherwise fixed relative to the holster to allow engagement of the extension 48 by the holster wearer.

It will be understood that forced insertion of the weapon into the holster or force applied to the weapon while in the holster could cause the trigger 38 to engage the extension 46 and discharge the weapon. Therefore, a weapon insertion limit rivet 52 or other insertion limit device is included to engage a portion of the weapon 16 in the event that the weapon is forced into the holster 10. In the preferred embodiment illustrated the rivet 52 engages the trigger guard 36.

In operation, in connection with the holster application previously mentioned to hold a weapon in the holster 10, the weapon holding means or mechanism 42 is incorporated or added to the holster 10 and provides the previously disclosed first and second engagement means. These are the extensions 46 and 48 previously described.

The one engagement means is located to hold the weapon in place against an attempted forced removal and the other engagement means or extension is located to allow the wearer of the holster to push out on the elongated strip and disengage the first extension, thereby allowing removal of the weapon. The order of steps is reversed to allow insertion of the weapon back into the holster.

In a preferred embodiment of the invention illustrated in FIGS. 1–9 the elongated strip is flexible or resilient and will return the first extension to the inserted position. An opening 56 is provided in the holster and located generally intermediate the end of the barrel 34 and a firing pin or hammer end 58 of the weapon.

Alternative embodiments of a further improved holster 110 are illustrated in FIGS. 10–44. The holster 110 comprises the conventional features of an adjustable support system 112 comprising a support strap 117 having a top portion 130 and a bottom portion 131. The top portion 130 of the support strap 117 having hook style fasteners 113 and loop style fasteners 114 attached by reinforced stitching 115. The hook and loop style fasteners 113, 114 provide adjustable attachment to a wearer's belt. In one preferred embodiment, the support strap 117 is approximately 15.63 inches long and 1.50 inches wide.

In the preferred embodiments, the support strap 117 of the adjustable support system 112 comprises an integral hanger 118 which provides positioning stability to the adjustable support system 112. The hanger 118 is held within the support strap 117 by lines of reinforced stitching 115 and bottom portion 131 of the support strap 117 is attached to the holster by reinforced stitching 115.

The hanger 118 comprises a top 127, a bottom 129, a front surface 119 and a back surface 120. The hanger 118 has a lower bend 124 and an upper bend 125. The lower bend 124 and the bottom 129 defining a lower portion 123 of the hanger 118, the lower bend 124 and the upper bend 125 defining an intermediate portion 122 of the hanger 118, the upper bend 125 and the top 127 defining an upper portion 121 of the hanger 118.

When the support strap 117 with the integral hanger 118 is attached to the holster 110, the front surface 119 faces the wearer of the holster and the back surface 120 faces the holster 110, such that the intermediate portion 122 and the upper portion 121 curve outward away from the holster 110 and towards the wearer of the holster thereby allowing the support strap 117 to conform to the contours of the holster 110 while not interfering with the insertion and removal of the weapon.

In one preferred embodiment, the hanger is comprised of a substantially rigid material approximately 0.1875 inches thick, 10.75 inches long, and 1.00 inch wide. Preferably, the cross sectional width of the intermediate portion 122 between the lower bend 124 and the upper bend 125 is approximately 1.00 inch.

Figure 10:
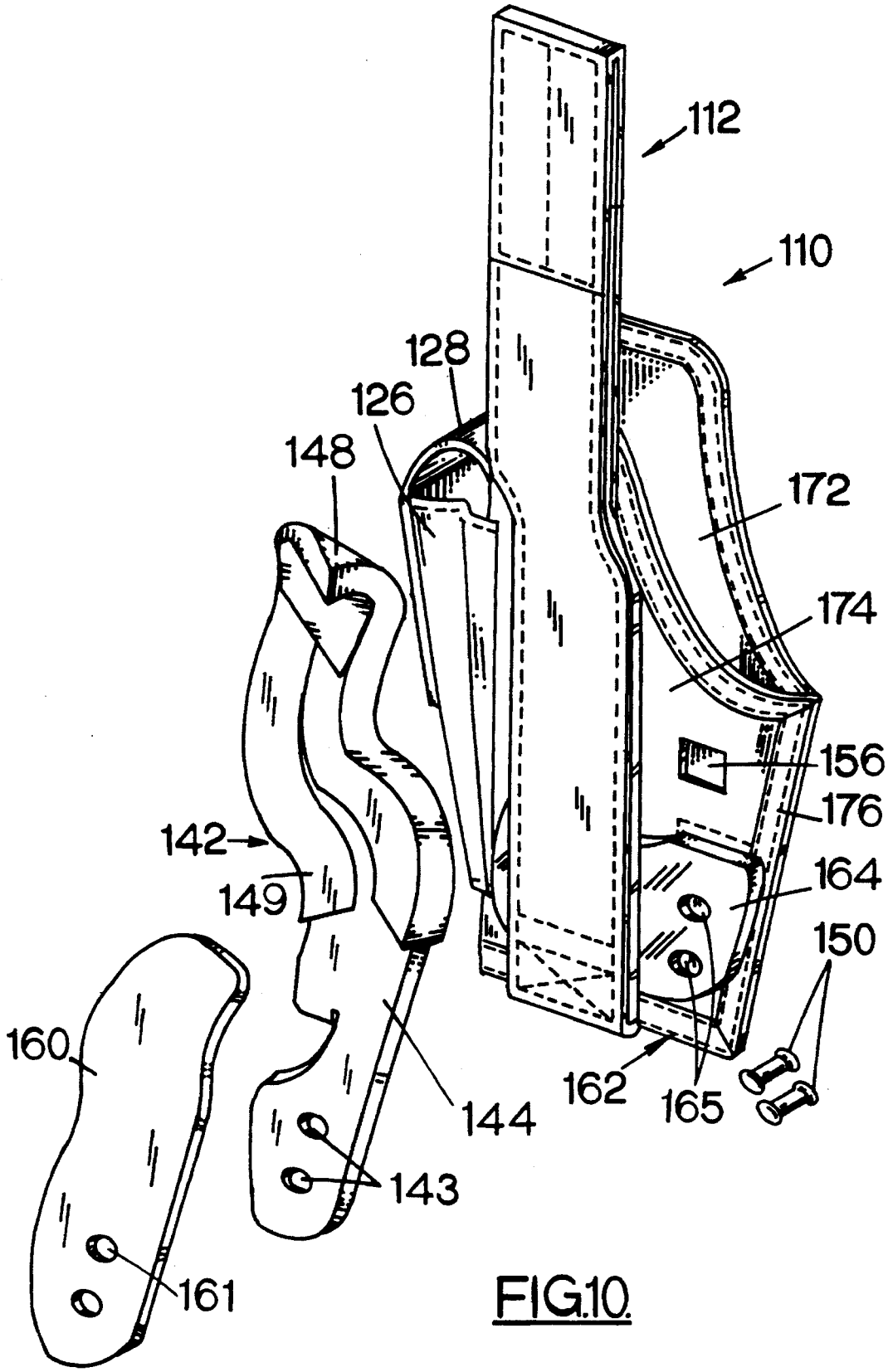
FIG. 10 is an exploded view of an alternate embodiment of the present invention.
Figure 11:
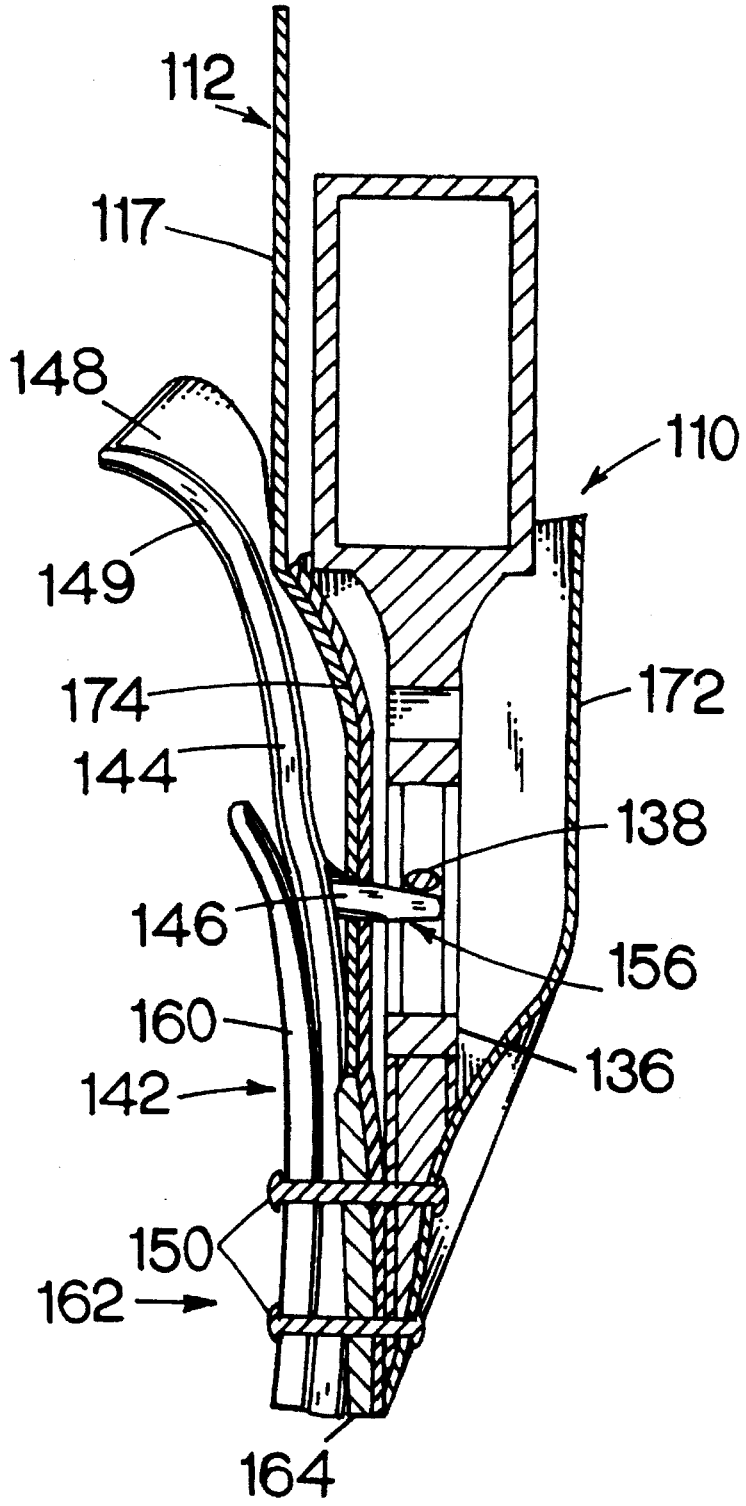
FIG. 11 is a cross-sectional view of the embodiment illustrated in FIG. 10.
Figures 12, 13, 14:
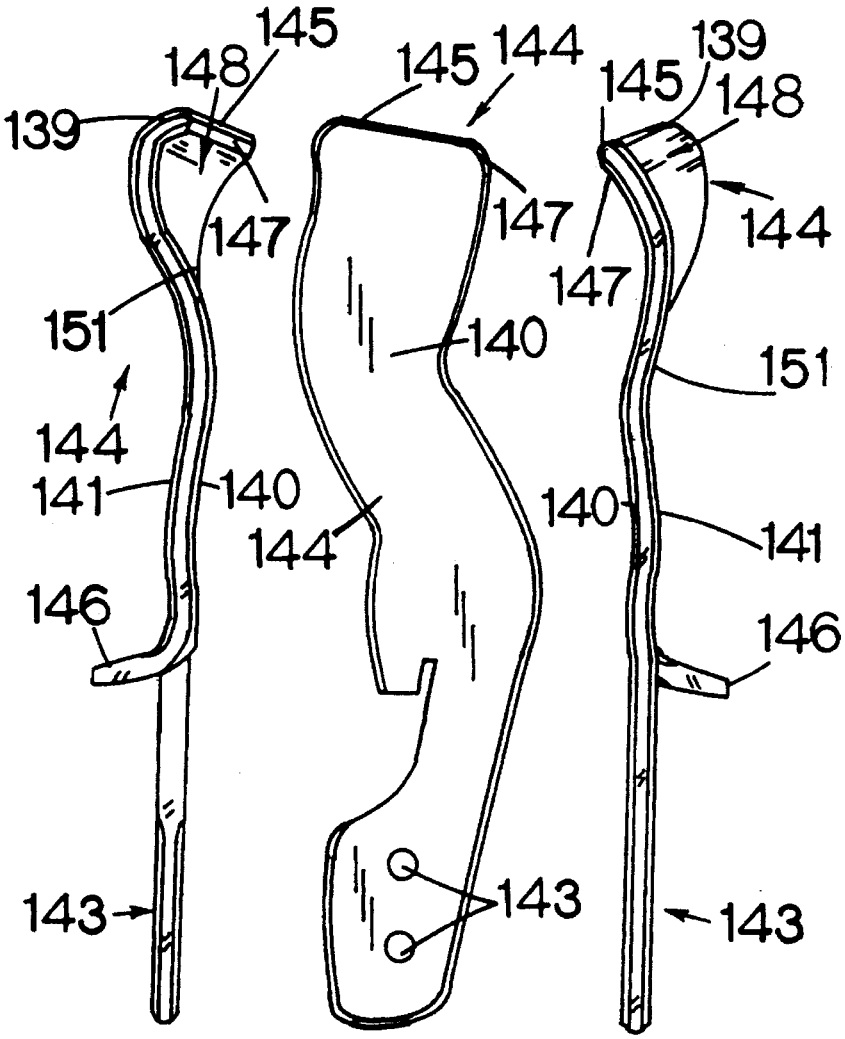
FIG. 12 is a front view of the weapon holding mechanism of the embodiment illustrated in FIG. 10.
FIG. 13 is a left end elevation view of the weapon holding mechanism of the embodiment illustrated in FIG. 10, showing the weapon retaining projection.
FIG. 14 is a right end elevation view of the weapon holding mechanism of the embodiment illustrated in FIG. 10, showing the weapon retaining projection.
Figure 15:
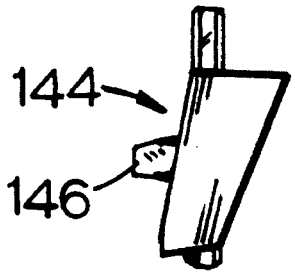
FIG. 15 is a top view of the weapon holding mechanism of the embodiment illustrated in FIG. 10, showing the weapon retaining projection.
Figure 16:
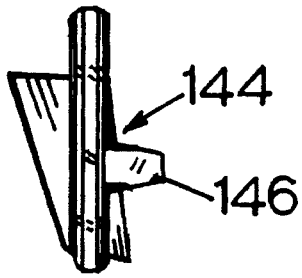
FIG. 16 is a bottom view of the weapon holding mechanism of the embodiment illustrated in FIG. 10, showing the weapon retaining projection.
Figure 22:
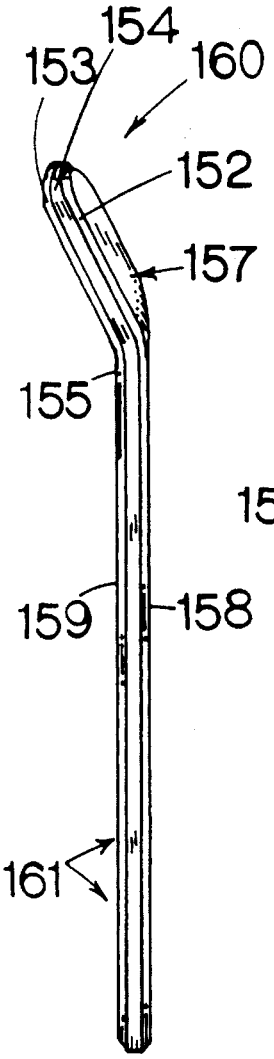
FIG. 22 is a left end elevation view of the paddle spring of the embodiment illustrated in FIG. 10.
Figure 23:
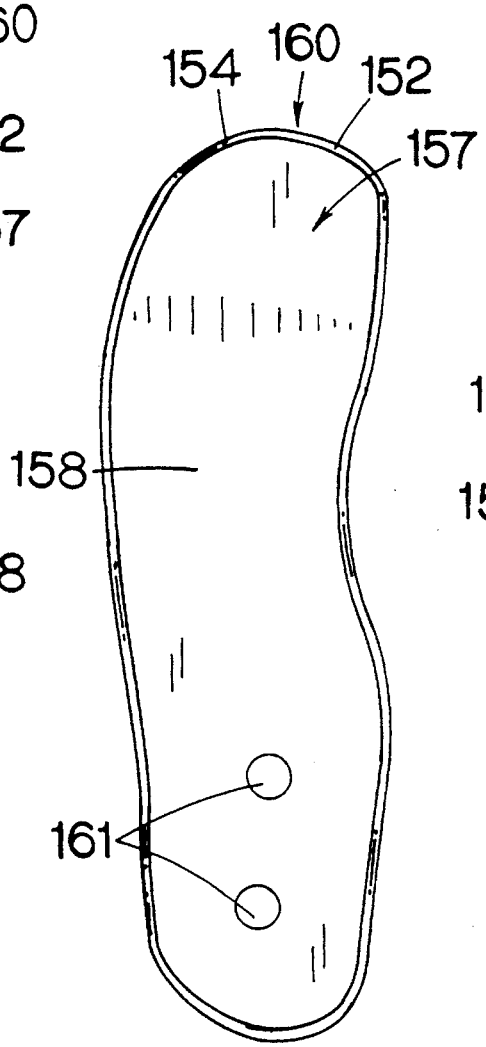
FIG. 23 is a front view of the paddle spring of the embodiment illustrated in FIG. 10.
Figure 24:
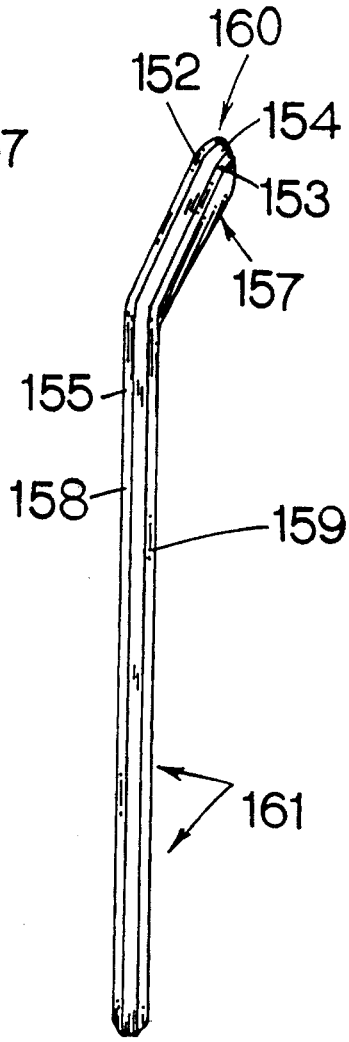
FIG. 24 is a right end elevation view of the paddle spring of the embodiment illustrated in FIG. 10.
Figure 26:
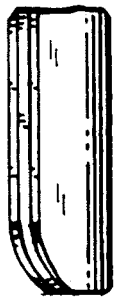
FIG. 26 is a top view of the paddle spring of the embodiment illustrated in FIG. 10.
Figure 25:
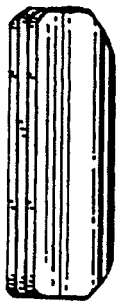
FIG. 25 is a bottom view of the paddle spring of the embodiment illustrated in FIG. 10.
Figure 27:
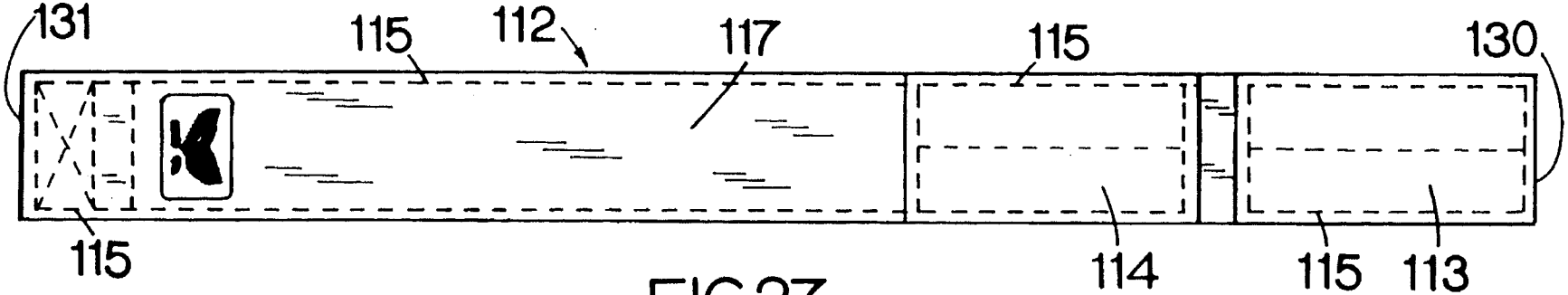
FIG. 27 is a front view of the adjustable support system of the embodiment illustrated in FIG. 10, showing the hook and loop style fasteners.
Figure 28:
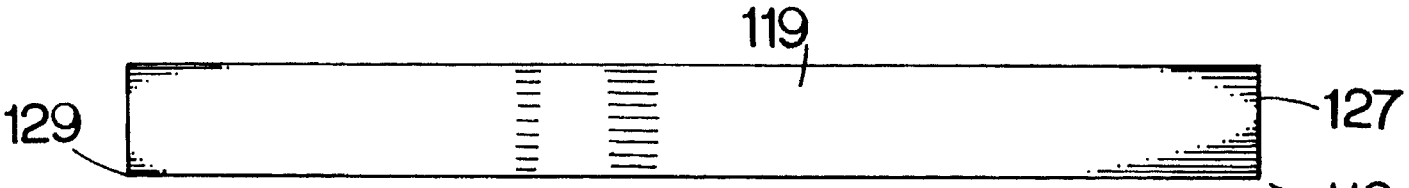
FIG. 28 is a front view of the hanger.
Figure 29:
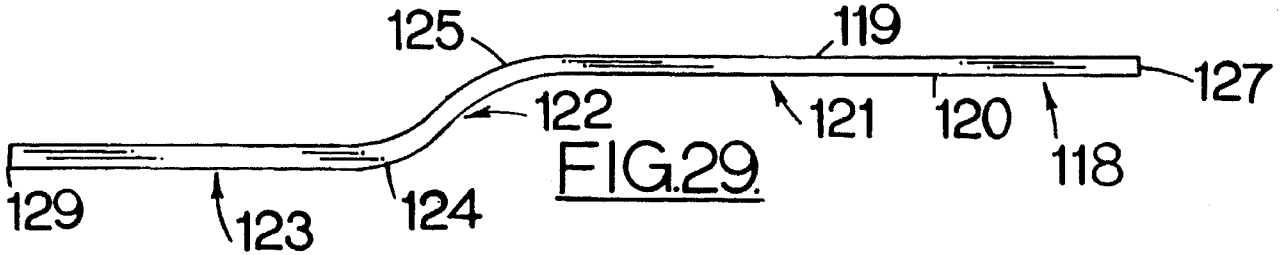
FIG. 29 is a right end elevation view of the hanger.
Figure 30:
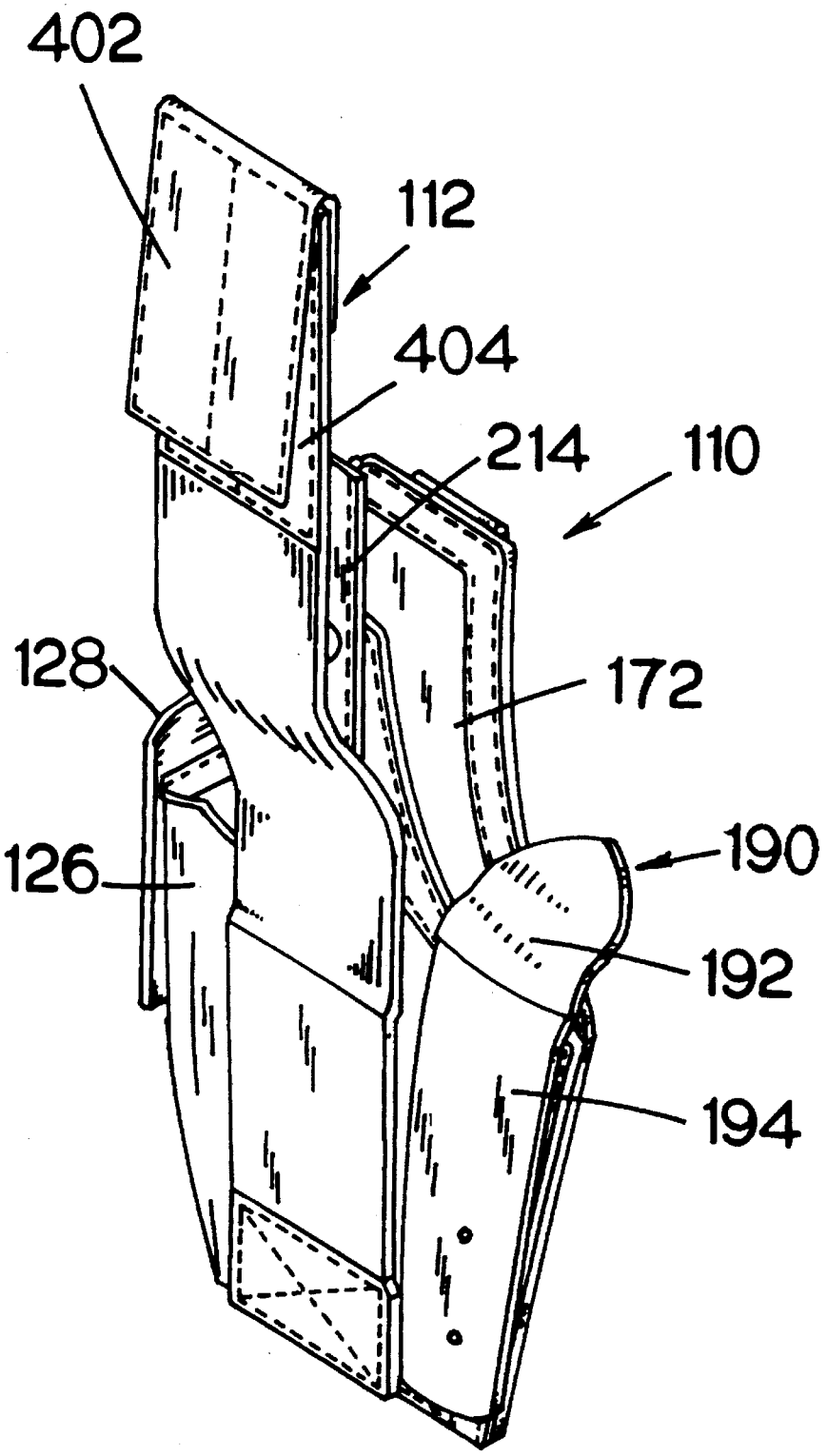
FIG. 30 is a perspective view of another embodiment of the weapon holding mechanism of the present invention constructed in accordance with the presently preferred embodiment.
Figure 32:
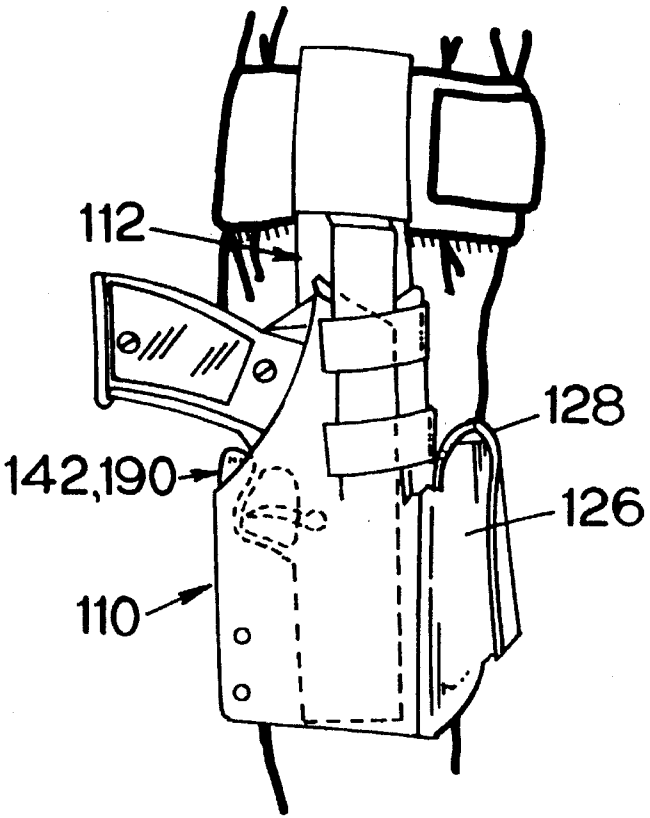
FIGS. 31–36 are side elevations of holsters incorporating the various embodiments of the present invention into a variety of waist, leg, arm, and side holsters.
Figure 31:
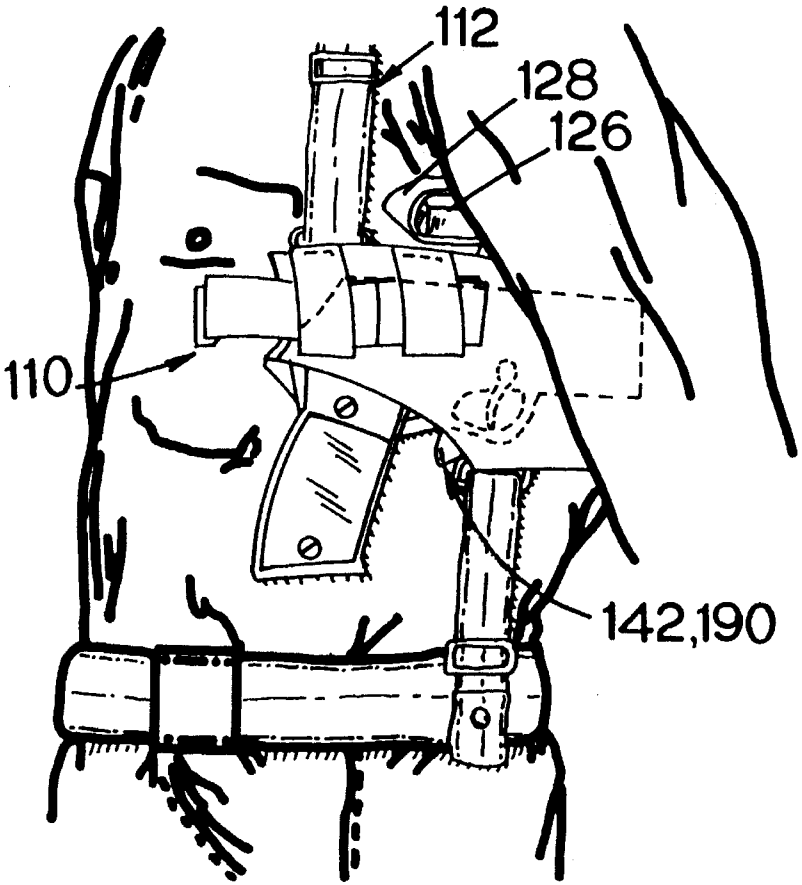
Figure 34:
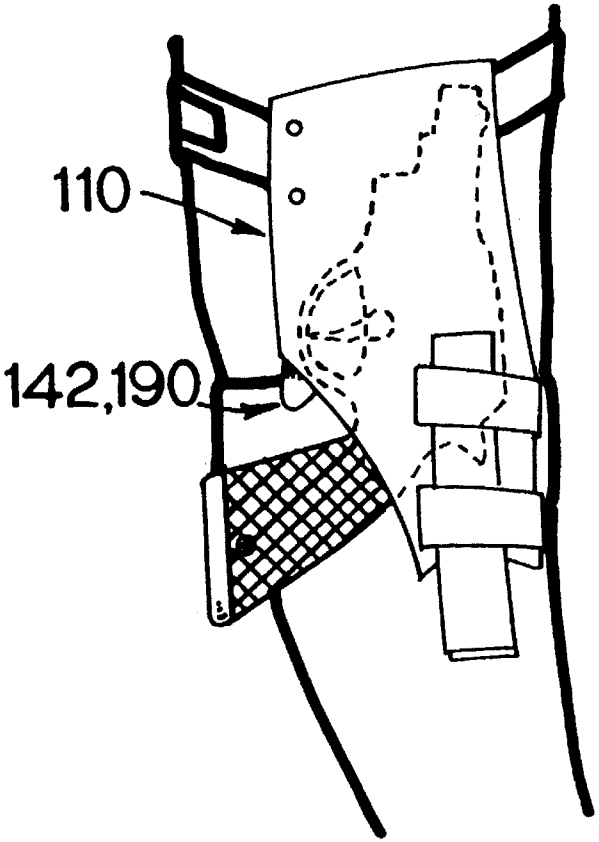
Figure 33:
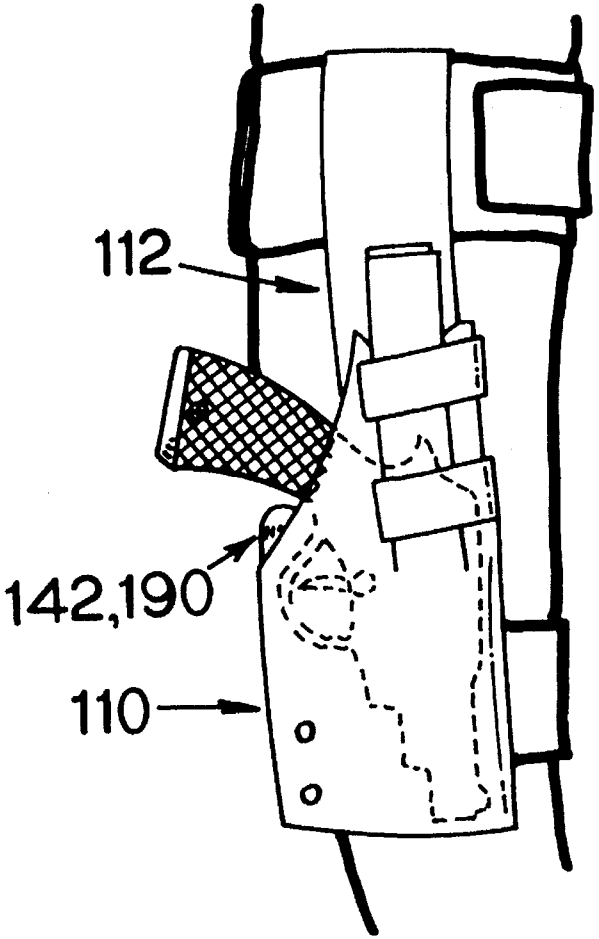
Figure 36:
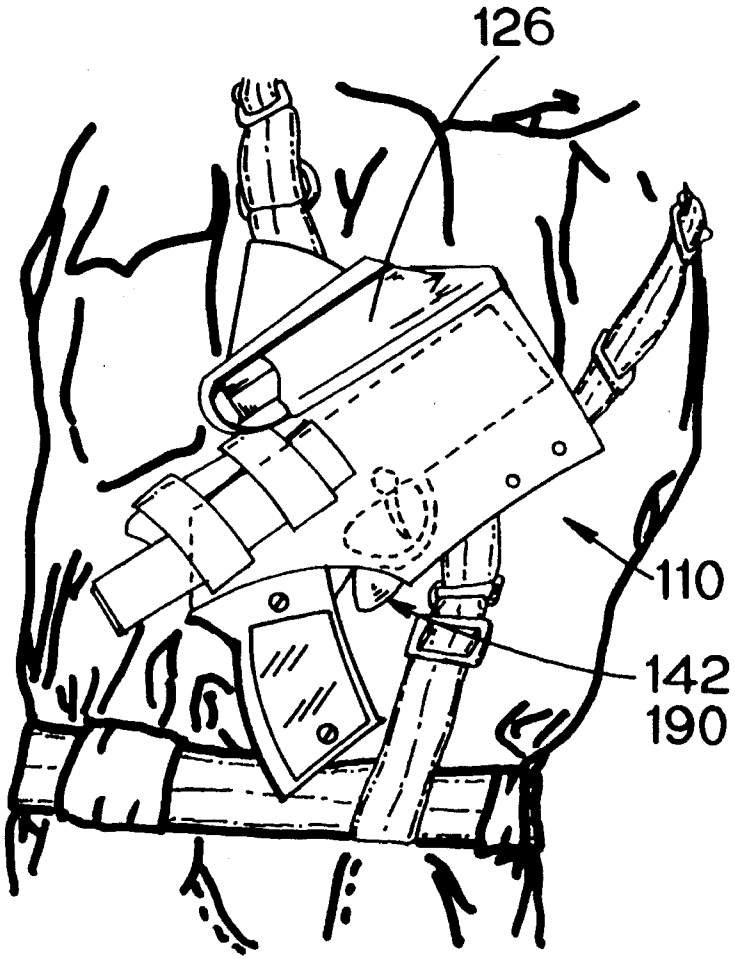
Figure 35:
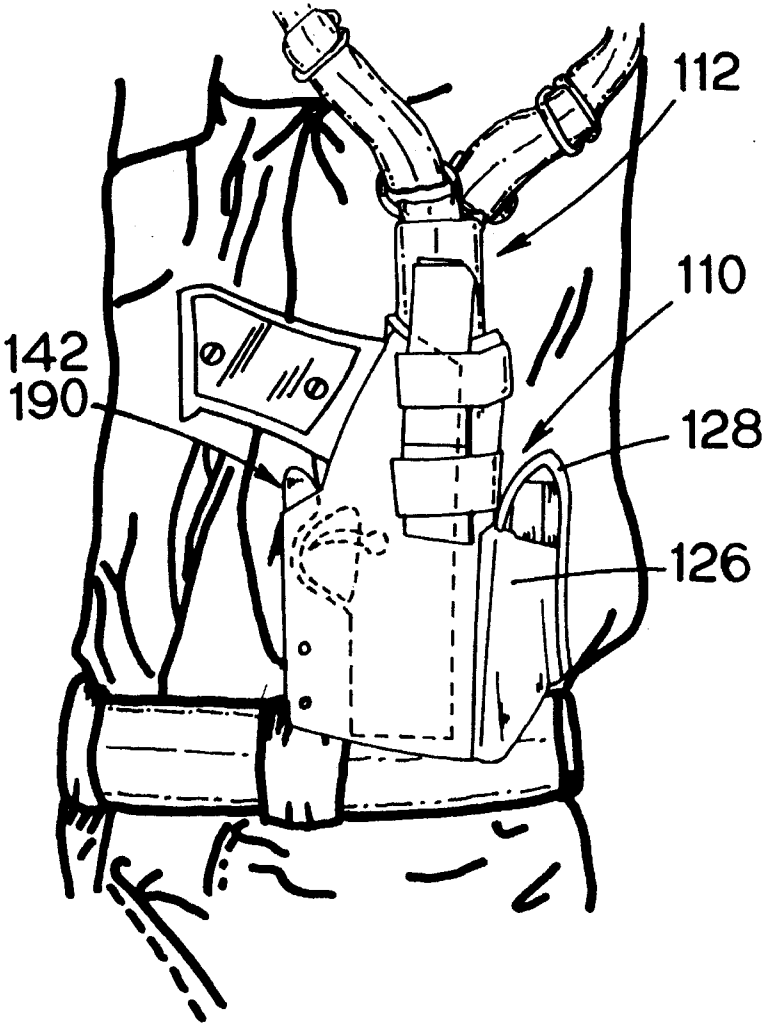

A weapon, a semi-automated or revolver 116 is shown positioned within the holster 110 in FIG. 11. An accessory pocket 126 and associated pocket closure straps 128 are illustrated in FIG. 10.

One embodiment of the improved holster 110 includes a weapon holding mechanism 142. The weapon holding mechanism 142 is preferably attached to the holster 110 by rivets 150, or otherwise fixed relative to the holster 110. This point of attachment acts as an attachment point 162.

The weapon holding mechanism 142 comprises a reinforcing support or paddle stabilizer 164 having a front surface 163 and a back surface 166, a retaining paddle member 144 having a front surface 140 and a back surface 141, and a biasing member or paddle spring 160 having a front surface 158 and a back surface 159.

The reinforcing support or paddle stabilizer 164 provides sufficient support to the back side 174 of the holster 110 to allow the retaining paddle member 144 to be moved about the attachment point 162 from the weapon holding position to a weapon insertion or release position. The paddle stabilizer 164 has apertures 165 for receiving rivets 150 such that the paddle stabilizer 164 is attached to the holster 110 at attachment point 162 by the rivets 150.

When attached to the holster 110, the back surface 166 of the paddle stabilizer 164 faces the back side 174 of the holster 110 and the front surface 163 of the paddle stabilizer 164 faces the back surface 141 of the retaining paddle member 144. The portion of the back surface 141 of the paddle stabilizer 164 which is not in contact with the retaining paddle member 144 is substantially covered by the adjustable support system 112.

The paddle stabilizer 164 provides sufficient support to allow biasing of the retaining paddle member 144 at the attachment point 162 without deflection of the holster 110 out and away from the wearer of the holster.

In a preferred embodiment of this version of the present invention, the paddle stabilizer 164 has a peripheral edge 167 with a front beveled portion 168 and a back beveled portion 169, is approximately 0.1875 inches thick, and is wide enough to substantially extend the width of the holster 110.

The retaining paddle member 144 has a weapon retaining projection 146 which extends from the retaining paddle member 144 and generally bends through an aperture 156 into the holster 110 and within the trigger guard 136 of the weapon without engaging the trigger 138. The retaining paddle member 144 has apertures 143 for receiving rivets 150. The retaining paddle member 144 is attached to the holster 110 at the attachment point 162 by the rivets 150. When attached to the holster 110, the back surface 141 of the retaining paddle member 144 faces the back side 174 of the holster 110 and the front surface 140 of the retaining paddle member 144 faces the wearer of the holster.

The retaining paddle member 144 further has a bend 155 defining an upper portion or release extension 148 of the retaining paddle member 144. The release extension 148, which preferably is an integral curving portion, projects away from an adjacent surface of the holster when the retaining paddle member 144 is attached to the holster 110. In a preferred embodiment, a covering member 149 may be provided to substantially cover the portion of the retaining paddle member 144 which is not in direct contact with the holster 110. The covering member 149 provides a cushion surface which will not mar or scratch the weapon and a wearing surface. Preferably, the covering member 149 has a textured surface which assists the wearer of the holster in gripping the release extension 148 of the retaining paddle member 144.

In a preferred embodiment, the retaining paddle member 144 generally has an elongated S-shape, is comprised of a flexible or resilient material, is approximately 0.25 inches thick, and has a peripheral edge 154 with a front beveled portion 152 and a back beveled portion 153. The elongated S-shape allows substantial conformity with the contour of the holster 110, such that the retaining paddle member 144 does not substantially obstruct access to the weapon by the holster wearer.

In this embodiment, the biasing plate or paddle spring 160 has apertures 161 for receiving rivets 150 such that the paddle spring 160 is attached to the holster 110 at the attachment point 162 by the rivets 150. When attached to the holster 110, the back surface 157 of the paddle spring 160 faces the front surface 140 of the retaining paddle member 144 and the front surface 158 of the paddle spring 160 faces the wearer of the holster. The paddle spring 160 is bent at 155 so as to define an upper portion 157 projecting towards the front surface 140 of the retaining paddle member 144, thereby providing bias to the retaining paddle member 144.

In this embodiment, the paddle spring 160 has a peripheral edge 154 with a front beveled portion 152 and a back beveled portion 153, and is approximately 0.1875 inches thick, and is long enough to extend from the attachment point 162 at rivets 150 to a position substantially above the retaining projection 146 of the retaining paddle member 144, such that a portion of the paddle spring 160 overlaps a portion of the covering member 149 on the retaining paddle member 144. The paddle spring 160 provides a biasing force against the retaining paddle member 144 to maintain the retaining projection 146 in position within the holster 110 and the weapon trigger guard 136.

(The presently preferred embodiment described below, represents the latest version of the present invention and is similar in most respects to the embodiment presently described except that it now has been determined that the weapon holding mechanism 142 will operate without the addition of the paddle spring and additional stiffener. Thus, the presently preferred embodiment should function as intended and with fewer pieces to assemble on new holsters or retro-fit to existing holsters.)

The holster 110 of this alternative embodiment is constructed so as to prevent the weapon from being inserted so far as to cause the trigger 138 to engage the weapon retaining projection 146 and discharge the weapon. In the preferred embodiment, the holster 110 has a front side or front leaf 172 and a back side or back leaf 174, the back leaf 174 facing the wearer of the holster. The front leaf 172 and the back leaf 174 are stitched together by a line of stitching 176. The line of stitching 176 engages the trigger guard 136 to prevent over insertion of the weapon. (This stitching arrangement is also found in the presently preferred embodiment.)

In operation, the wearer of the holster applies sufficient force against the release extension 148 to overcome the bias of paddle spring 160 against the retaining paddle member 144. This retracts the weapon retaining projection 146 from the holster 110 through aperture 156. The holster 110 is then free from obstruction to allow insertion of the weapon.

The wearer of the holster then releases the release extension 148, whereupon the paddle spring 160 returns the retaining paddle member 144 to its original position, the retaining projection 146 moving into the holster 110 through aperture 156 to come into proximate engaging relationship with the trigger guard 136 of the weapon. In this position, any attempt to forcibly remove the weapon from the holster 110 results in contact of the weapon retaining projection 146 with the weapon trigger guard 136.

In the presently preferred embodiment the holster of the present invention is constructed without the external paddle spring member and the external stiffener member. The presently preferred embodiment is illustrated in FIGS. 30–44.

The aforementioned figures variously illustrate the addition of a sight guide to the inside surface of the holster and a modification to the weapon engaging portion of the weapon holding mechanism. It will be understood from these latter illustrated embodiments that the novel variation of the presently preferred embodiment is the sole use of the weapon holding mechanism.

The holster 110 is further equipped with a sight guide 180. The sight guide is affixed to the holster and preferably extends the length of the holster from a top curled over portion 182 to a bottom curled over portion 184. The sight guide also functions as a guide for removing and inserting the weapon into the holster when the weapon sight travels in the groove 186 of the site guide.

The holster has been further modified by placing all stiffeners in between the material of the holster. Thus, an internal stiffener 188 is provided.

An opening is placed in the holster to function in cooperation with a trigger stop 190. The trigger stop has an upper extension 192 which is engaged by the wearer in order to force lever member 194 away from the holster. This disengages the trigger stop 146 or 196 from the weapon or pulls the trigger stop back through the opening in the holster so as to allow replacement of the weapon.

Two embodiments of the trigger stop are illustrated in the drawings. One embodiment 146 is an extension of the member 142 or 190 and another embodiment 196 is integral with or attached to the member 190.

The lever is pivoted at its point of connection with the holster. The lever is attached to the holster and the internal stiffener 188 with appropriate screws 195 placed through openings 197 and 199 and suitable screw receiving members to firmly attach the member 142 or the member 190 to the internal stiffener 188.

Figure 37:
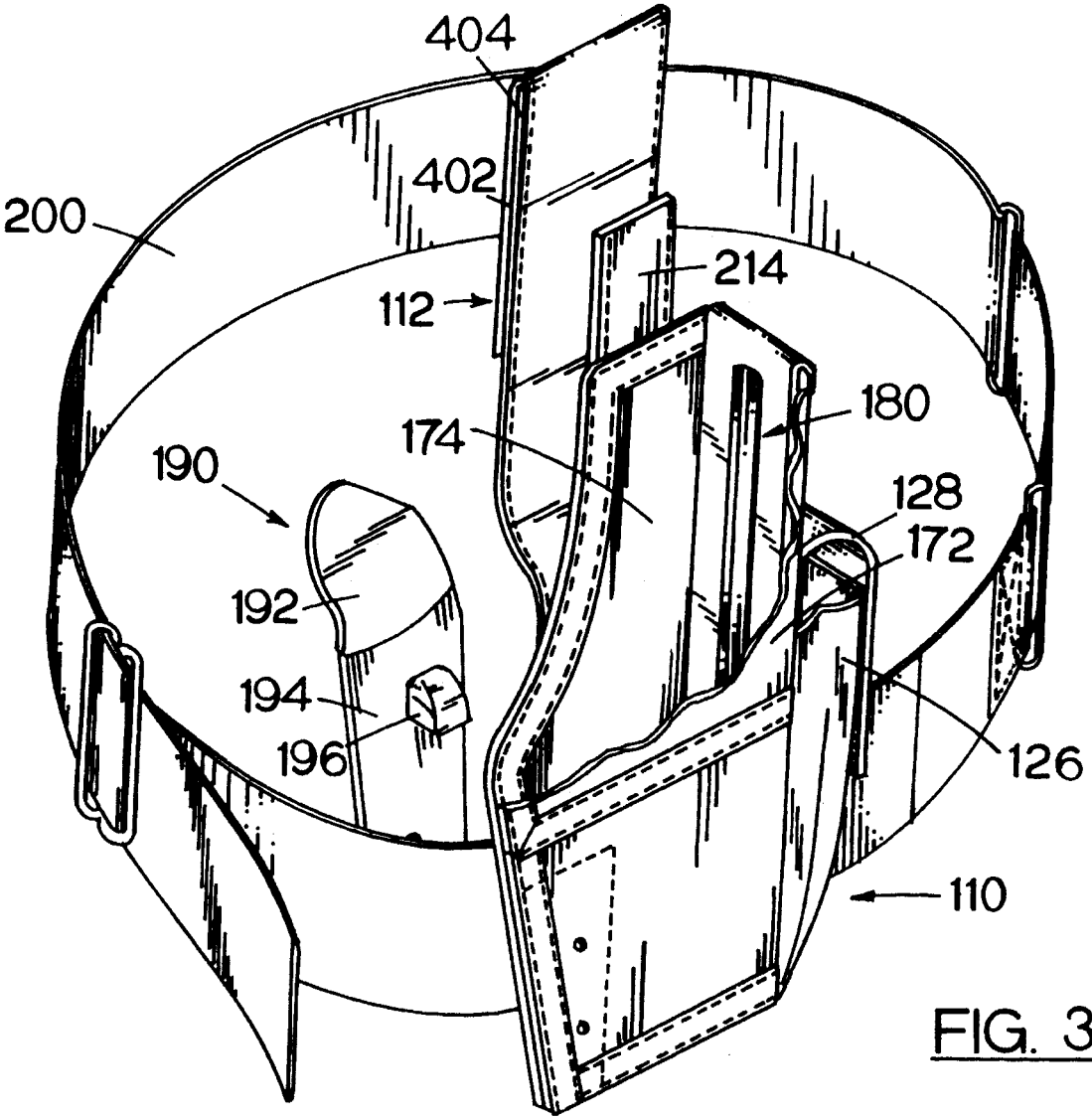
FIG. 37 is a perspective view of the present invention connected to a belt that fits around the waist of the user with an outside portion of the holster cut away to show the sight channel and the elongated flexible or resilient strip is broken away to show the first extension that engages the trigger guard.
Figure 38:
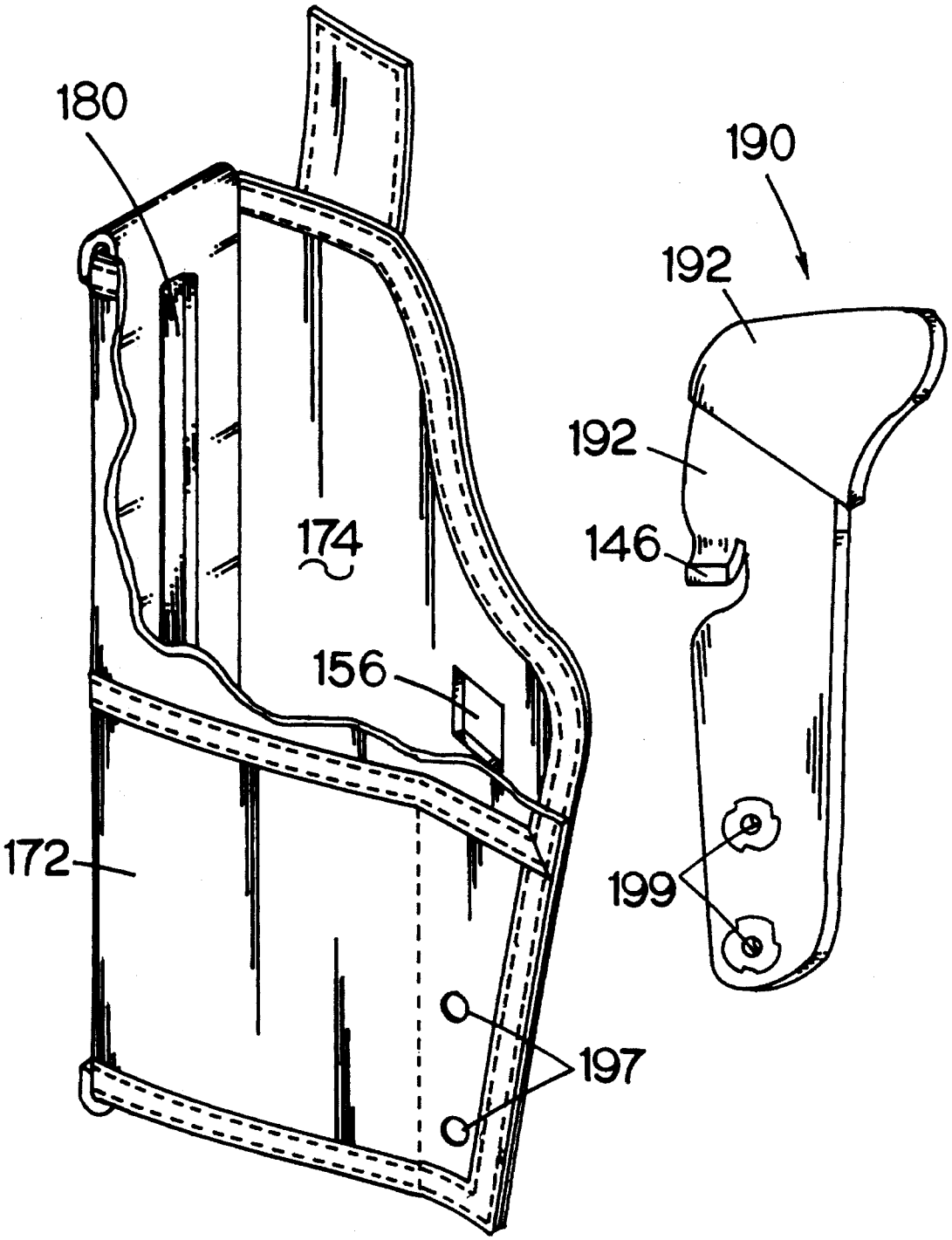
FIG. 38 is an unattached holster with an outside portion cut away and the flexible or resilient strip broken away to reveal the aperture through which the first extension engages the trigger guard.
Figure 40:
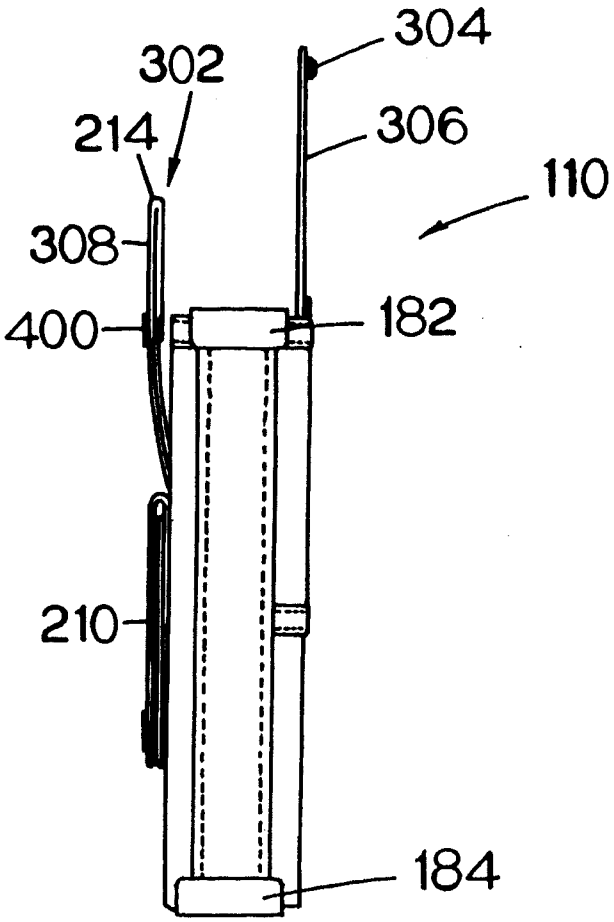
FIG. 40 is the front view of another embodiment of the holster with a pocket on the side.
Figure 39:
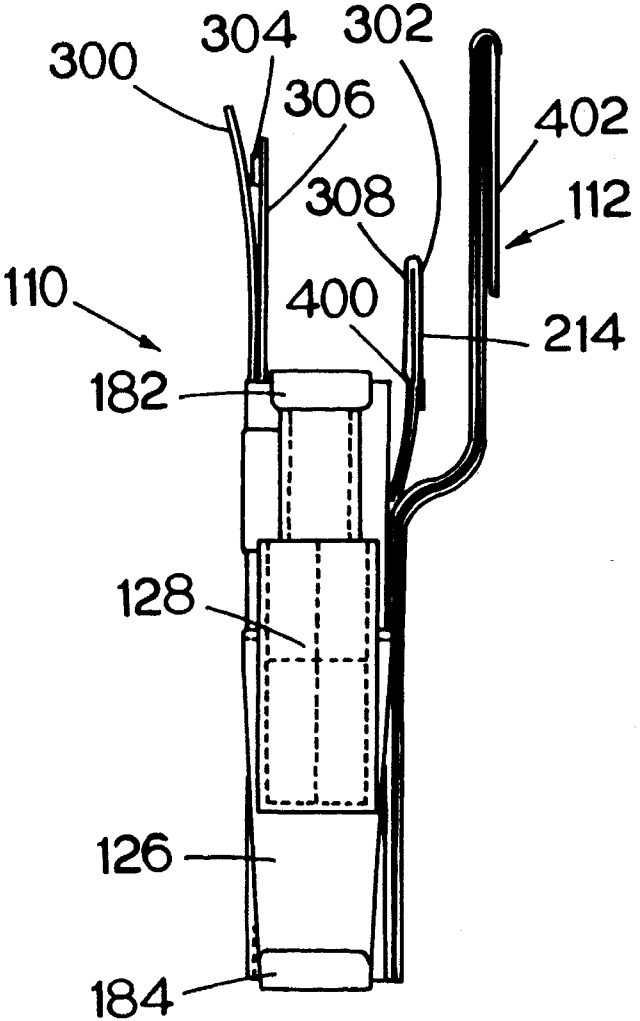
FIG. 39 is the front view an embodiment of the holster which illustrates a conventional pouch used for carrying extra ammunition in a clip.
Figure 41:
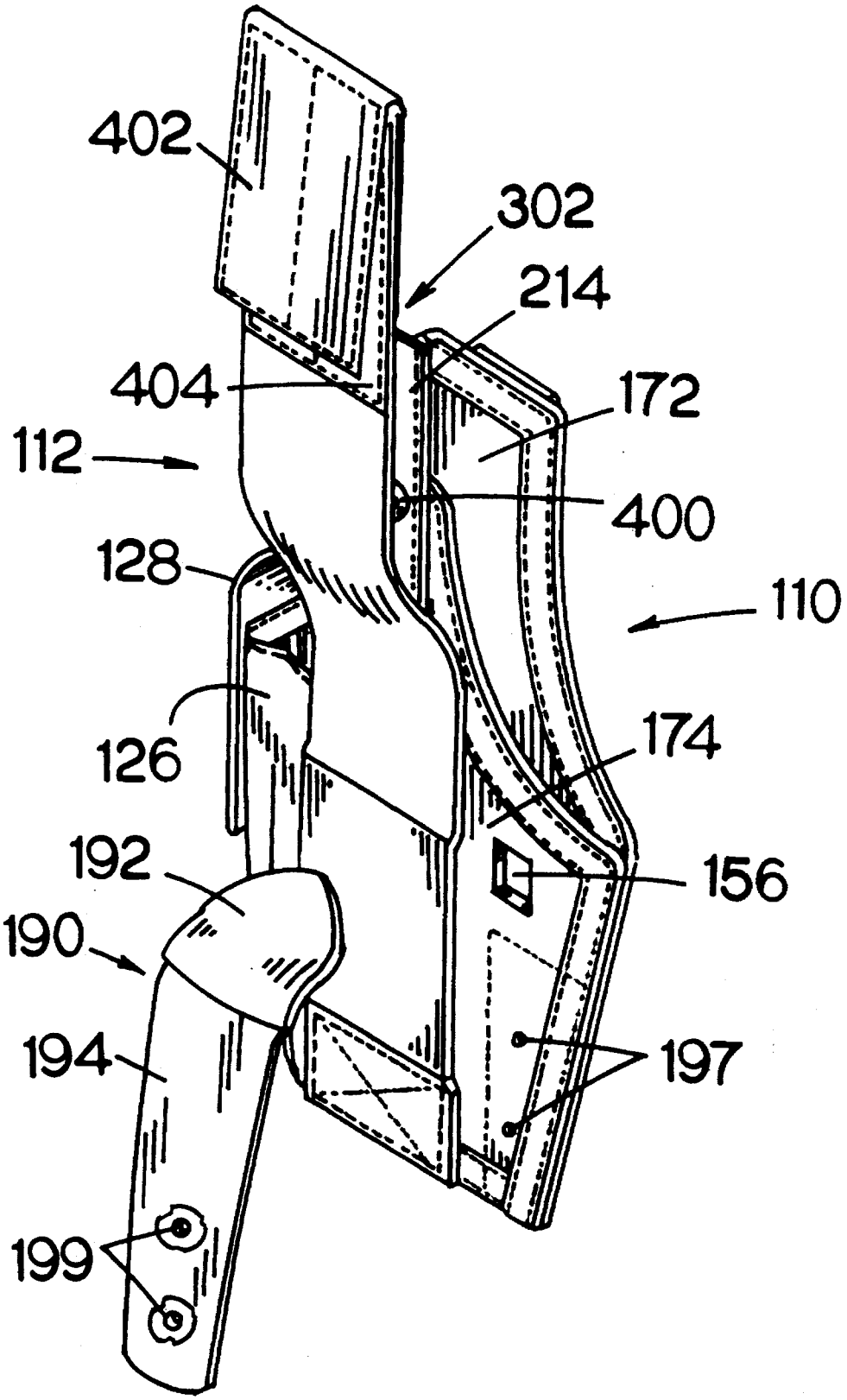
FIG. 41 is the inside portion of the holster illustrated in FIG. 39 with the flexible or resilient strip separated to reveal the aperture through which the first extension engages the trigger guard.

Typical materials used in the construction of the holster, for example as illustrated in FIG. 37 are a 40 HAWK MN for the inside of the holster and a BALLISTIC material for the outside of the holster. One skilled in the art will realize that the holster is made up of these material or their equivalents with an intermediate or middle stiffener layer of a 20 HAWK MM.

Thus, it is now apparent that the holster is stiffened with both the intermediate layer of material and, further, by the addition of the internal stiffener 188. These two stiffening materials or their equivalents are believed to be sufficient for the desired operation of the present invention and may be found, after additional work, to satisfactorily supplant the embodiment described with the external stiffener and additional spring.

The holster may be used with an external strap 200 and with a variety of side pockets 200 with snap closures 212. It will be understood that a variety of pockets and straps are readily available and useable with conventional holsters as well as the holster of the present invention.

A relatively rigid extension 214 is located intermediate the holster and the member 112. The extension 214 is stiffened in a manner and to an extent similar to the member 112. A strap 300 and a strap 306 are both located on the opposite side of the holster from extension 214.

Extension 214 and strap 306 have complementary snaps 303 and 304, and 400 or their equivalents. The extension 214 and the strap 306 function as a hammer strap to further retain the weapon in the holster. In addition, there is shown a flexible strap 300 which is used over the aforementioned hammer strap for further security. The flexible strap 300 and the extension 214 have complementary hook and loop fasteners 301 and 303 or their equivalents.

Figure 42:
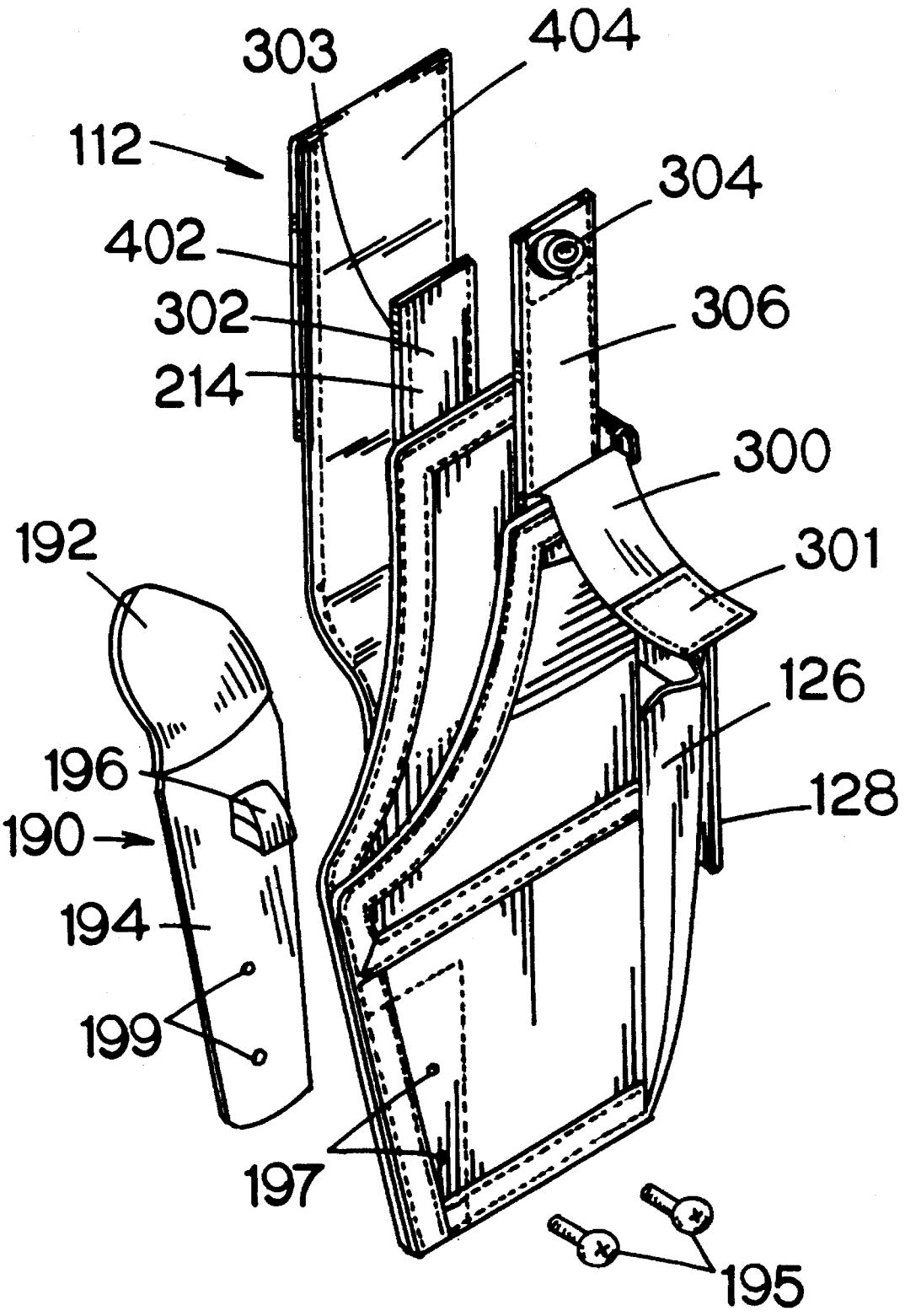
FIG. 42 is the outside portion of the holster in FIG. 39 with the flexible or resilient strip disconnected and the screws separated from the holster for purposes of illustrating the construction of the holster.
Figure 43:
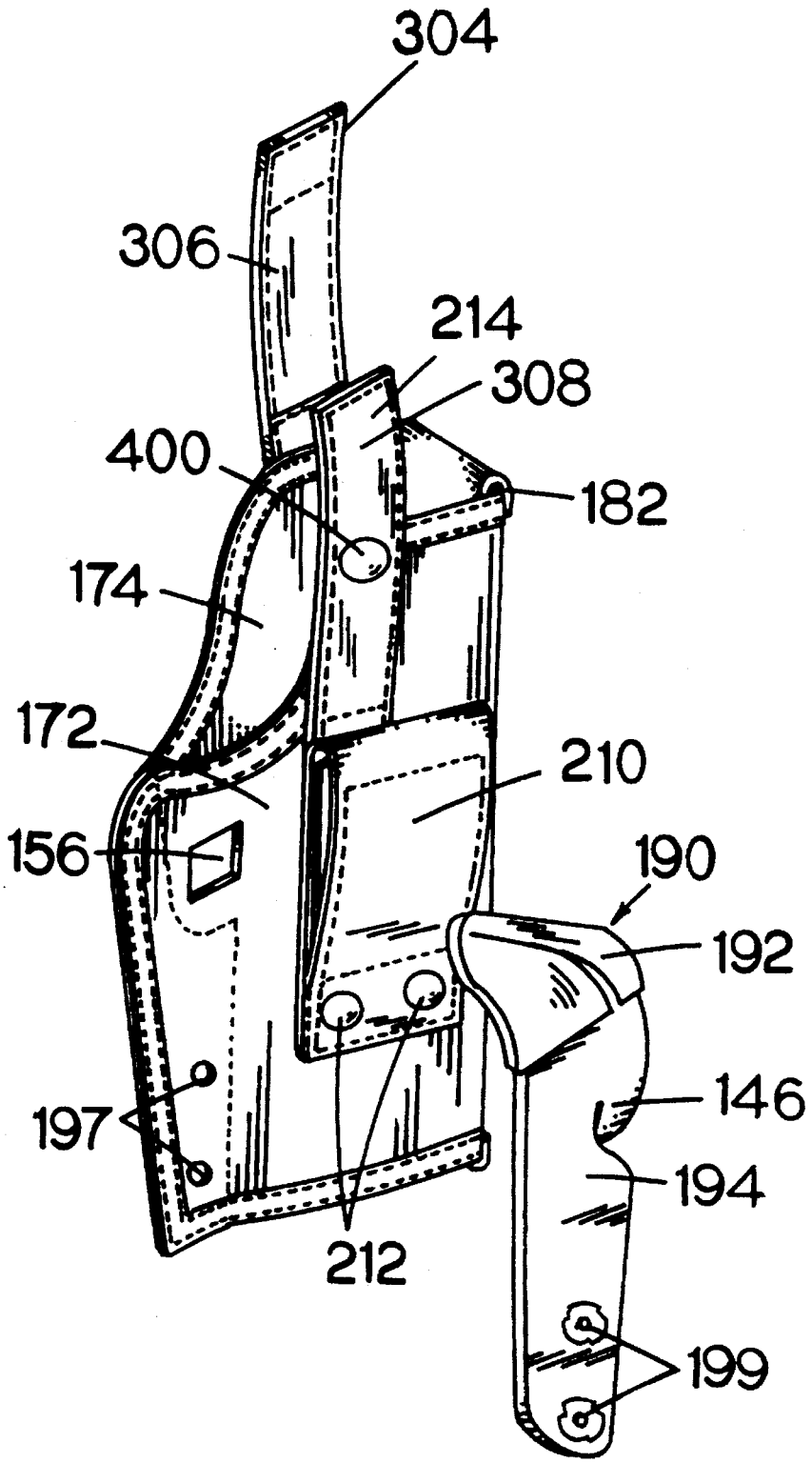
FIG. 43 is the inside portion of the holster in FIG. 40 with the flexible or resilient strip disconnected.
Figure 44:
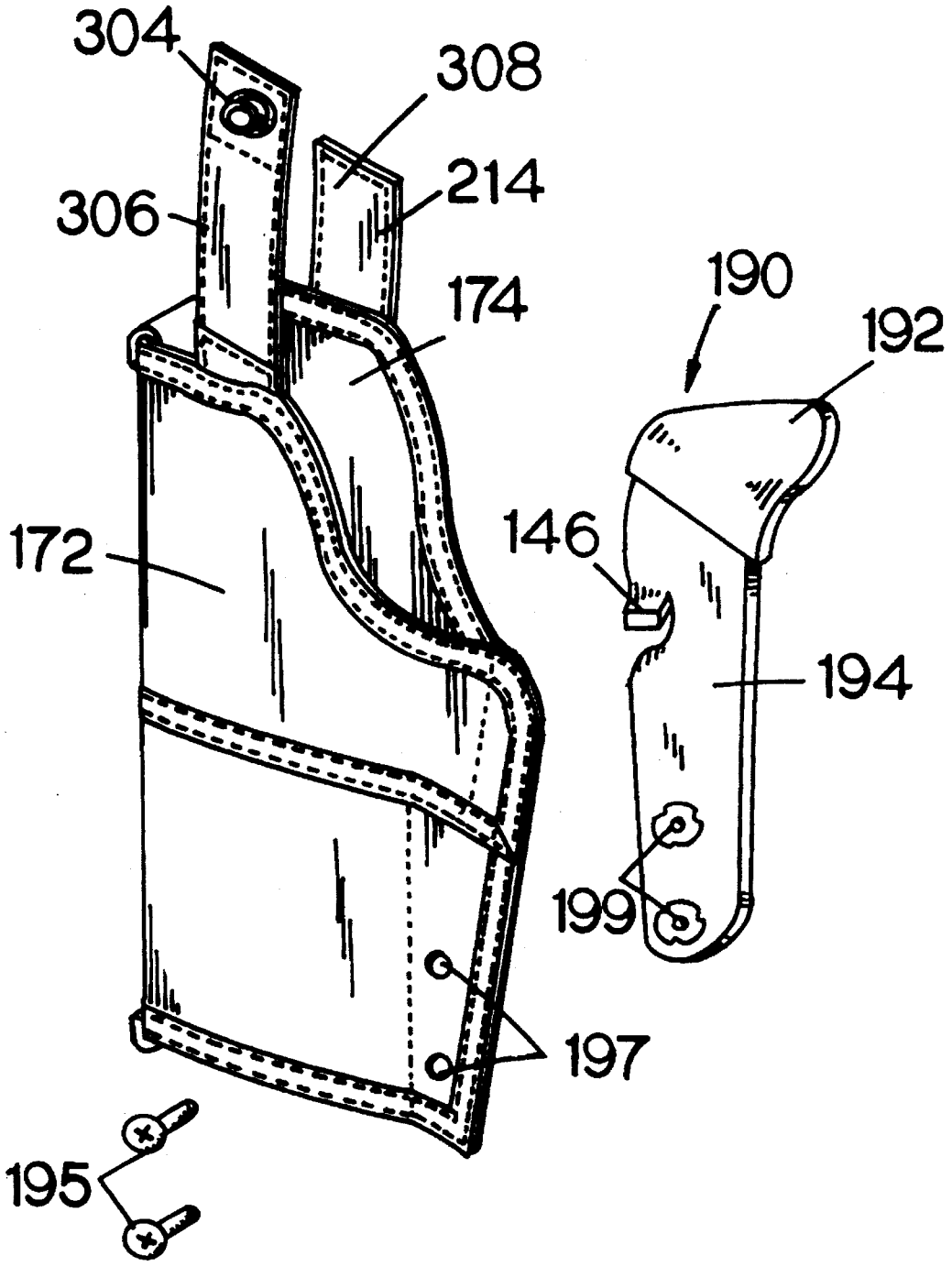
FIG. 44 is the outside portion of the holster in FIG. 40 with the flexible or resilient strip disconnect and the screws separated from the holster in order to suggest one method of constructing the holster.

FIGS. 42 and 43 illustrate two (2) examples of the holster of the present invention. These two figures illustrate opposite hand holsters with FIG. 43 illustrating the holster without the extension 112. The extension 112 may also have hook and loop material 402 and 404 to further attach the holster to the wearer.

From the foregoing description those skilled in the art will appreciate that all of the objects of the present invention are realized. An improved holster has been shown and described for providing the desired security of retaining a weapon in a holster. An improved holster is adapted to decrease the risk that a wearer of the holster will accidently or forcibly, under certain circumstances, lose the weapon from the holster by the use of an extension that engages the weapon when in the holster.

While specific embodiments have been shown and described, many variations are possible. The particular style of holster of weapon adaptable or useable with present invention is indicated by the illustrations of various holsters incorporating the holding mechanism of the present invention. The mechanism and holster materials may vary although plastic and nylon are preferable. Also, in the embodiments described and illustrated, there have been shown only a few of the many weapon holsters that can use the improvement of the present invention.

Having described the invention in detail, those skilled in the art will appreciate that modifications may be made of the invention without departing from its spirit. Therefore, it is not intended that the scope of the invention be limited to the specific embodiments illustrated and described. Rather it is intended that the scope of this invention be determined by the appended claims and their equivalents.

What is claimed is:

1. An improved top opening and top removal holster for a semi-automatic or revolver weapon having a trigger mechanism and a trigger guard or similar enclosure for the trigger, the improvement comprising:

a top opening and top removal holster;

limiting means for preventing overinsertion of a weapon in the holster;

a holding means for releasably holding the weapon within the holster; and the holding means including a retaining paddle member attached proximate an end of the holster adjacent a weapon barrel when the weapon is in the holster, the retaining paddle member having a weapon retaining projection and a release extension for manually moving the weapon retaining projection from a weapon holding position to a weapon insertion or release position, the retaining paddle member having a portion attached to an exterior portion of the holster allowing movement relative to the holster when the release extension is manually moved prior to the insertion or removal of the weapon, an attachment point located where the portion of the retaining paddle member attaches to the holster.

2. An improved holster as defined in claim 1 wherein the limiting means comprises reinforced stitching in combination with the holster for limiting insertion of the weapon into the holster by contacting a trigger guard.

3. An improved holster as defined in claim 1 wherein the retaining paddle member is comprised of a sufficiently resilient material to allow movement of the weapon retaining projection from the weapon holding position to the weapon release or insertion position without permanent substantial deformation to the retaining paddle member.

4. An improved holster as defined in claim 1 wherein the holding means further comprises a paddle spring to bias the retaining paddle member in a weapon holding position and a paddle stabilizer to provide sufficient support at the attachment point to allow biasing of the retaining paddle member at the attachment point without deflection of the holster.

5. An improved top opening and top removal holster for a semi-automatic or revolver weapon having a trigger mechanism and a trigger guard or similar enclosure for the trigger, the improvement comprising:

a top opening and top removal holster having a support strap, a hammer strap comprising an extension and a strap, a security strap, and an aperture for receiving a weapon retaining projection;

a retaining paddle member comprising the weapon retaining projection and a release extension for manually moving the weapon retaining projection from a weapon holding position to a weapon insertion or release position, the retaining paddle member having a portion attached to an exterior portion of the holster at an attachment point adjacent a weapon barrel when the weapon is in the holster; and a limiting means to limit insertion of the weapon into the holster, the limiting means comprising reinforced stitching in combination with the holster.

6. An improved holster as defined in claim 5 wherein the holster is substantially stiffened with a plurality of stiffening materials.

7. An improved holster as defined in claim 5 wherein the holster further comprises one or more pockets.

8. An improved holster as defined in claim 5 wherein the holster further comprises a sight guide.

9. An improved holster as defined in claim 5 wherein the support strap further comprises an integral hanger having a plurality of bends such that the support strap can substantially conform to a contour of the holster while not interfering with the insertion and removal of the weapon.

10. An improved holster as defined in claim 5 wherein the extension of the hammer strap is substantially stiffened by one or more stiffening materials.

11. An improved top opening and top removal holster for a semi-automatic or revolver weapon having a trigger mechanism and a trigger guard or similar enclosure for the trigger, the improvement comprising:

a substantially stiffened holster having a support strap with an integral hanger having a plurality of bends, a hammer strap comprising a substantially stiffened extension and a strap, a security strap, and an aperture for receiving a weapon retaining projection;.

a retaining paddle member comprising the weapon retaining projection and a release extension for manually moving the weapon retaining projection from a weapon holding position to a weapon insertion or release position, the retaining paddle member having a portion attached to an exterior portion of the holster at an attachment point adjacent a weapon barrel when the weapon is in the holster; and a limiting means comprising reinforced stitching in combination with the holster which limits insertion of the weapon into the holster.

12. An improved holster as defined in claim 11 wherein the holster further comprises one or more pockets.

13. An improved holster as defined in claim 11 wherein the holster further comprises a sight guide.

14. An improved holster as defined in claim 11 wherein the support strap further comprises fastening means.

15. An improved holster as defined in claim 11 wherein the substantially stiffened extension of the hammer strap further comprises fastening means.

16. An improved holster as defined in claim 11 wherein the strap of the hammer strap further comprises fastening means.

17. An improved holster as defined in claim 11 wherein the security strap further comprises fastening means.

* * * * *